US009620268B2

(12) United States Patent
Tsubokura et al.

(10) Patent No.: US 9,620,268 B2
(45) **Date of Patent: *Apr. 11, 2017**

(54) R-T-B BASED ALLOY STRIP, AND R-T-B BASED SINTERED MAGNET AND METHOD FOR PRODUCING SAME

(71) Applicant: TDK CORPORATION, Tokyo (JP)

(72) Inventors: Taeko Tsubokura, Tokyo (JP); Eiji Kato, Tokyo (JP); Tamotsu Ishiyama, Tokyo (JP); Nobuhiro Jingu, Tokyo (JP); Chikara Ishizaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 431 days.

This patent is subject to a terminal disclaimer.

(21) Appl. No.: 14/350,438

(22) PCT Filed: Oct. 11, 2012

(86) PCT No.: PCT/JP2012/076346

§ 371 (c)(1),
(2) Date: Apr. 8, 2014

(87) PCT Pub. No.: WO2013/054854

PCT Pub. Date: Apr. 18, 2013

(65) Prior Publication Data

US 2014/0308152 A1 Oct. 16, 2014

(30) Foreign Application Priority Data

Oct. 13, 2011 (JP) ..... 2011-226040
Oct. 13, 2011 (JP) ..... 2011-226042
(Continued)

(51) Int. Cl.
*C22C 38/10* (2006.01)
*C22C 33/02* (2006.01)
(Continued)

(52) U.S. Cl.
CPC ..... *H01F 1/053* (2013.01); *B22D 11/0611* (2013.01); *C22C 38/002* (2013.01);
(Continued)

(58) Field of Classification Search
CPC ... B22D 11/0611; H01F 1/053; H01F 1/0536; H01F 1/0571; H01F 1/0577;
(Continued)

(56) References Cited

U.S. PATENT DOCUMENTS 5,431,747 A * 7/1995 Takebuchi ..... C22C 33/02 420/83
7,311,788 B2 * 12/2007 Nishizawa ..... C22C 38/002 148/302
(Continued)

FOREIGN PATENT DOCUMENTS

CN 1442253 A 9/2003
CN 1942264 A 4/2007
(Continued)

OTHER PUBLICATIONS

Apr. 15, 2014 International Preliminary Report on Patentability issued in International Application No. PCT/JP2012/076327.
(Continued)

*Primary Examiner* — Helene Klemanski
(74) *Attorney, Agent, or Firm* — Oliff PLC

(57) ABSTRACT

An R-T-B based alloy strip including columnar crystals of an $R_2T_{14}B$ phase, wherein in a cross-section along the thickness direction, columnar crystals extend out in a radial fashion from the crystal nuclei, the R-T-B based alloy strip satisfying the following inequality (1), where $D_1$ and $D_2$ are, respectively, the average value for the lengths of the columnar crystals on one side and the average value for the lengths
(Continued)

on the other side that is opposite the one side, in the direction perpendicular to the thickness direction of the cross-section.

$$0.9/1.1 \leq D_2/D_1 \leq 1.1/0.9 \quad (1)$$

6 Claims, 13 Drawing Sheets

(30) Foreign Application Priority Data

Nov. 14, 2011 (JP) ..... 2011-248978
Nov. 14, 2011 (JP) ..... 2011-248980

(51) Int. Cl.

| | |
|---|---|
| ***B22D 11/06*** | (2006.01) |
| ***H01F 1/053*** | (2006.01) |
| ***H01F 1/057*** | (2006.01) |
| ***H01F 1/08*** | (2006.01) |
| ***H01F 41/02*** | (2006.01) |
| ***C22C 38/00*** | (2006.01) |
| ***C22C 38/06*** | (2006.01) |
| ***C22C 38/14*** | (2006.01) |
| ***C22C 38/16*** | (2006.01) |

(52) U.S. Cl.
CPC ..... *C22C 38/005* (2013.01); *C22C 38/06* (2013.01); *C22C 38/10* (2013.01); *C22C 38/14* (2013.01); *C22C 38/16* (2013.01); *H01F 1/0536* (2013.01); *H01F 1/0571* (2013.01); *H01F 1/086* (2013.01); *H01F 41/0266* (2013.01); *C22C 33/02* (2013.01); *C22C 2202/02* (2013.01); *H01F 1/0577* (2013.01)

(58) Field of Classification Search
CPC ..... H01F 1/086; H01F 41/0266; C22C 33/02; C22C 38/002; C22C 38/005; C22C 38/10; C22C 2202/02
USPC ..... 148/101; 419/33; 420/83; 75/246
See application file for complete search history.

(56) References Cited

U.S. PATENT DOCUMENTS

| | | | | |
|---|---|---|---|---|
| 7,314,531 | B2 * | 1/2008 | Ishizaka | H01F 1/0577 148/302 |
| 7,390,369 | B2 | 6/2008 | Odaka et al. | |
| 8,152,936 | B2 * | 4/2012 | Tsubokura | H01F 1/0577 420/83 |
| 8,157,927 | B2 * | 4/2012 | Enokido | H01F 1/0577 148/101 |
| 2006/0165550 | A1 * | 7/2006 | Enokido | H01F 1/0577 420/40 |
| 2007/0199624 | A1 | 8/2007 | Shintani et al. | |
| 2010/0200121 | A1 | 8/2010 | Shintani et al. | |
| 2012/0024429 | A1 * | 2/2012 | Hayakawa | H01F 1/0577 148/302 |
| 2012/0235778 | A1 * | 9/2012 | Kunieda | H01F 1/0577 335/302 |
| 2014/0247100 | A1 * | 9/2014 | Tsubokura | H01F 1/053 419/33 |
| 2014/0286815 | A1 * | 9/2014 | Ishiyama | H01F 1/053 419/33 |
| 2014/0286816 | A1 * | 9/2014 | Kato | H01F 1/053 419/33 |
| 2014/0308152 | A1 * | 10/2014 | Tsubokura | H01F 1/053 419/33 |

FOREIGN PATENT DOCUMENTS

| | | |
|---|---|---|
| JP | B2-3693838 | 9/2005 |
| JP | A-2006-265609 | 10/2006 |
| JP | A-2008-264875 | 11/2008 |
| JP | A-2011-210838 | 10/2011 |
| WO | 2004/094090 A1 | 11/2004 |
| WO | WO 2005/095024 A1 | 10/2005 |

OTHER PUBLICATIONS

Apr. 15, 2014 International Preliminary Report of Patentability issued in International Application No. PCT/JP2012/076346.
Apr. 15, 2014 International Preliminary Report of Patentability issued in International Application No. PCT/JP2012/076324.
Jan. 22, 2013 International Search Report issued in International Patent Application No. PCT/JP2012/076327.
Jan. 22, 2013 International Search Report issued in International Patent Application No. PCT/JP2012/076346.
Jan. 22, 2013 International Search Report issued in International Patent Application No. PCT/JP2012/076324.
Jan. 22, 2013 International Search Report issued in International Patent Application No. PCT/JP2012/076310.
U.S. Appl. No. 14/351,199, filed Apr. 11, 2014 in the name of Kato et al.
U.S. Appl. No. 14/351,119, filed Apr. 10, 2014 in the name of Ishiyama et al.
U.S. Appl. No. 14/350,728, filed Apr. 9, 2014 in the name of Tsubokura et al.
Apr. 15, 2014 International Preliminary Report on Patentability issued in International Patent Application No. PCT/JP2012/076310.
Aug. 22, 2016 Office Action issued in U.S. Appl. No. 14/351,199.
Aug. 19, 2016 Office Action issued in U.S. Appl. No. 14/351,119.

* cited by examiner (A)

(B)

R-T-B BASED ALLOY STRIP, AND R-T-B BASED SINTERED MAGNET AND METHOD FOR PRODUCING SAME

TECHNICAL FIELD

The present invention relates to an R-T-B based alloy strip, and to an R-T-B based sintered magnet and a method for producing the same.

BACKGROUND ART

For driving motors used in a variety of different fields, there is increasing demand for smaller sizes and lighter weights, as well as increased efficiency, in line with the goal of reducing installation space and lowering cost. Along with this demand there is a desire for techniques that allow further improvement in, for example, the magnetic properties of sintered magnets to be used in driving motors.

R-T-B based rare earth sintered magnets have been used in the past as sintered magnets with high magnetic properties. It has been attempted to improve the magnetic properties of R-T-B based sintered magnets using heavy rare earth metals such as Dy and Tb, which have large anisotropic magnetic fields $H_A$. However, with the rising costs of rare earth metal materials in recent years, there has been a strong desire to reduce the amount of usage of expensive heavy rare earth elements. In light of this situation, it has been attempted to improve magnetic properties by micronizing the structures of R-T-B based sintered magnets.

Incidentally, R-T-B based sintered magnets are produced by powder metallurgy methods. In production methods by powder metallurgy, first the starting material is melted and cast, to obtain an alloy strip containing the R-T-B based alloy. Next, the alloy strip is ground to prepare alloy powder having particle diameters of between several μm and several tens of μm. The alloy powder is then molded and sintered to produce a sintered compact. Next, the obtained sintered compact is worked to the prescribed dimensions. In order to improve the corrosion resistance, the sintered compact may be subjected to plating treatment if necessary to form a plating layer. It is thus possible to obtain an R-T-B based sintered magnet.

In the production method described above, melting and casting of the starting material are usually accomplished by a strip casting method. A strip casting method is a method in which the molten alloy is cooled with a cooling roll to form an alloy strip. In order to improve the magnetic properties of R-T-B based sintered magnets, it has been attempted to control the alloy structure by adjusting the cooling rate in the aforementioned strip casting method. For example, PTL 1 proposes obtaining an alloy strip comprising chill crystals, particulate crystals and columnar crystals with prescribed particle diameters, by a strip casting method.

FIG. 11 is a schematic cross-sectional view showing the cross-sectional structure of an R-T-B based alloy strip produced by a conventional strip casting method, along the thickness direction. The R-T-B based alloy strip contains columnar or resin-like crystals 2 of a $R_2T_{14}B$ phase, as the main phase, and a grain boundary phase 4 such as an R-rich phase at the grain boundaries of the crystals 2.

CITATION LIST

Patent Literature

[PTL 1] Japanese Patent No. 3693838 specification

SUMMARY OF INVENTION

Technical Problem

With an alloy strip such as described in PTL 1, however, the shape and size variation of the alloy powder obtained by grinding the alloy strip is considerable. When such alloy powder is used to produce a sintered magnet, the non-uniform shapes and sizes of the alloy powder make it difficult to significantly improve the magnetic properties. Consequently, it is desirable to establish techniques that allow further improvement in the magnetic properties of R-T-B based sintered magnets.

The coercive force (HcJ) and residual flux density (Br) of a sintered magnet have established relationships represented by the following formulas (I) and (II).

$$HcJ=\alpha\cdot H_A-N\cdot Ms \quad \text{(I)}$$

$$Br=Ms\cdot(\rho/\rho_0)\cdot f\cdot A \quad \text{(II)}$$

In formula (I), α is a coefficient representing the independence of the crystal grains, $H_A$ represents the anisotropic magnetic field that is dependent on the structure, N represents the local demagnetizing field dependent on shape, etc., and Ms represents the saturation magnetization of the main phase. Also, in formula (II), Ms represents the saturation magnetization of the main phase, ρ represents the sintered density, $\rho_0$ represents the true density, f represents the volume ratio of the main phase, and A represents the degree of orientation of the main phase. Of these coefficients, $H_A$, Ms and f are dependent on the structure of the sintered magnet, and N is dependent on the shape of the sintered magnet. As clearly seen from formula (I), increasing a in formula (I) can increase the coercive force. This suggests that controlling the structure of the alloy powder used in the compact for a sintered magnet allows the coercive force to be increased.

It is an object of the present invention, which has been accomplished in light of these circumstances, to provide an alloy strip that can increase the coercive force of an R-T-B based sintered magnet. It is another object of the invention to provide an R-T-B based sintered magnet that does not employ an expensive heavy rare earth element and has sufficiently excellent coercive force, as well as a method for producing it.

Solution to Problem

The present inventors have conducted much research centered on alloy strip structures with the aim of increasing the magnetic properties of R-T-B based sintered magnets. As a result, we have found that by micronizing the structure of the alloy strip and increasing its homogeneity, the finally obtained R-T-B based sintered magnet structure is micronized and R-rich phase segregation is inhibited, so that high magnetic properties can be stably obtained.

Specifically, the invention provides an R-T-B based alloy strip comprising columnar crystals of an $R_2T_{14}B$ phase, wherein the columnar crystals extend out in a radial fashion from the crystal nuclei in a cross-section along the thickness direction, the R-T-B based alloy strip satisfying the following inequality (1), where $D_1$ and $D_2$ are, respectively, the average value for the lengths of the columnar crystals on one side and the average value for the lengths on the other side that is opposite the one side, in the direction perpendicular to the thickness direction of the cross-section.

$$0.9/1.1 \le D_2/D_1 \le 1.1/0.9 \quad (1)$$

According to the invention, the shapes of the columnar crystals extending in the thickness direction of the R-T-B based alloy strip do not spread out in the direction perpendicular to the thickness direction, and variation in the shapes and widths of the columnar crystals is adequately reduced. Usually when an R-T-B based alloy strip is ground, the grain boundary phase, such as the R-rich phase at the grain boundaries of the $R_2T_{14}B$ phase columnar crystals, are preferentially fractured. The form of the alloy powder therefore depends on the shapes of the columnar crystals of the $R_2T_{14}B$ phase. The columnar crystals of the $R_2T_{14}B$ phase in the R-T-B based alloy strip of the invention have sufficiently reduced variation in the columnar crystal shapes and widths, and it is thus possible to obtain an R-T-B based alloy powder with sufficiently reduced variation in form and size. This allows an R-T-B based sintered magnet to be obtained having minimized segregation of the R-rich phase as well as increased homogeneity of the microstructure.

In other words, the present invention does not employ a method of control by simply micronizing the $R_2T_{14}B$ phase in the R-T-B based alloy strip, but rather controls the variation in the sizes and shapes of the $R_2T_{14}B$ phase columnar crystals to obtain a sharp structural distribution, and to increase the coercive force of the finally obtained R-T-B based sintered magnet.

The R-T-B based alloy strip of the invention preferably satisfies the following inequalities (2) and (3), where $D_{AVE}$ and $D_{MAX}$ are, respectively, the average value and maximum value for the lengths of the columnar crystals in the direction perpendicular to the thickness direction, in the aforementioned cross-section.

$$1.0\ \mu m \leq D_{AVE} \leq 3.0\ \mu m \quad (2)$$

$$1.5\ \mu m \leq D_{MAX} \leq 4.5\ \mu m \quad (3)$$

Since such an R-T-B based alloy strip has sufficiently small widths of the columnar crystals of the $R_2T_{14}B$ phase and also sufficiently reduced variation in shapes, it can yield R-T-B based alloy powder that is micronized and has sufficiently increased homogeneity of form and size. This further increases the homogeneity of the microstructure of the finally obtained R-T-B based sintered magnet. As a result, the coercive force of the R-T-B based sintered magnet can be further increased.

The R-T-B based alloy strip of the invention contains an R-rich phase in which the R content is higher than the $R_2T_{14}B$ phase based on mass, and the percentage of the number of R-rich phases with lengths of no greater than 1.5 μm in the direction perpendicular to the thickness direction, with respect to the total number of R-rich phases, in the cross-section, is preferably 90% or greater. This allows an R-T-B based alloy powder to be obtained that is even more micronized and has even more size homogeneity. As a result, the coercive force of the finally obtained R-T-B based sintered magnet can be even further increased. An R-rich phase is a phase with a higher R content based on mass than the $R_2T_{14}B$ phase.

According to another aspect, the present invention provides an R-T-B based sintered magnet obtained by molding and firing alloy powder obtained by grinding the aforementioned R-T-B based alloy strip. Since the R-T-B based sintered magnet uses R-T-B based alloy powder with sufficiently reduced variation in columnar crystal shapes and sizes as the starting material, it has sufficiently excellent coercive force.

According to yet another aspect, the invention provides a method for producing an R-T-B based sintered magnet, which includes a step of grinding the aforementioned R-T-B based alloy strip to prepare an alloy powder, and a step of molding and firing the alloy powder to produce an R-T-B based sintered magnet. By this production method it is possible to obtain an R-T-B based sintered magnet having sufficiently excellent coercive force, since it employs fine alloy powder having sufficiently reduced variation in columnar crystal shapes and sizes, and that has satisfactory homogeneity of dispersion of the R-rich phase.

Advantageous Effects of Invention

According to the invention it is possible to provide an alloy strip that can increase the coercive force of an R-T-B based sintered magnet. It is also possible to provide an R-T-B based sintered magnet having sufficiently excellent coercive force, as well as a method for producing it.

DESCRIPTION OF EMBODIMENTS

Figure 1:
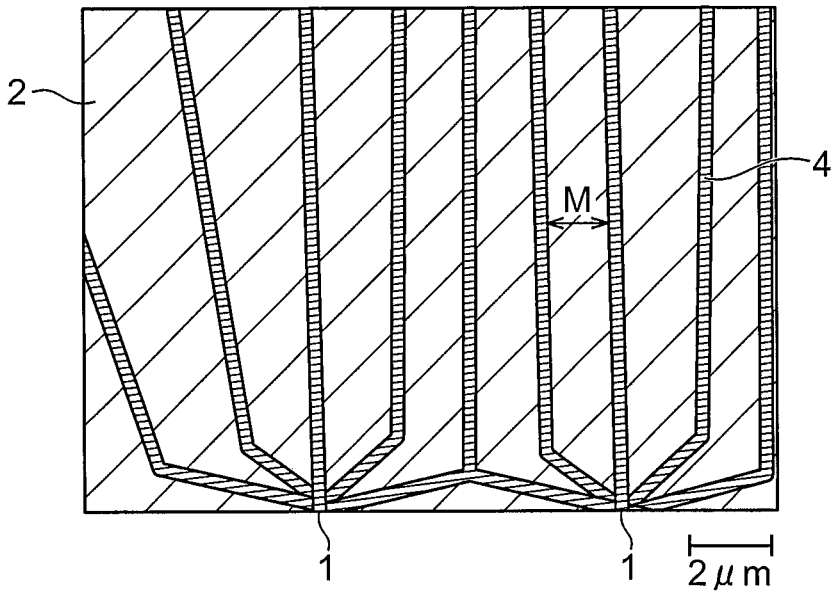
FIG. 1 is a schematic cross-sectional enlarged view of a section of a cross-section of an R-T-B based alloy strip according to an embodiment of the invention, along the thickness direction.

Preferred embodiments of the invention will now be explained with reference to the accompanying drawings where necessary. For the drawings, identical or corresponding elements will be referred to by like reference numerals and will be explained only once.

<R-T-B Based Alloy Strip>

FIG. 1 is a schematic cross-sectional enlarged view showing the cross-sectional structure of an R-T-B based alloy strip of this embodiment along the thickness direction. The R-T-B based alloy strip of this embodiment contains $R_2T_{14}B$ phase columnar crystals 2 as the main phase and a grain boundary phase 4 having a different structure than the $R_2T_{14}B$ phase. The grain boundary phase 4 includes, for example, an R-rich phase. An R-rich phase is a phase with a higher R content than the $R_2T_{14}B$ phase.

As shown in FIG. 1, the R-T-B based alloy strip has crystal nuclei 1 on one surface. Also, the crystal nuclei 1 serve as origins from which the columnar crystals and grain boundary phase extend in a radial fashion toward the other surface. The grain boundary phase 4 is deposited along the grain boundaries of the $R_2T_{14}B$ phase columnar crystals 2. Throughout the present specification, R represents elements including at least one selected from among rare earth elements, T represents elements including at least one of iron and cobalt, and B represents boron.

The term "rare earth element", for the purpose of the present specification, refers to scandium (Sc), yttrium (Y) and lanthanoid elements belonging to Group 3 of the long Periodic Table, the lanthanoid elements including, for example, lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) and lutetium (Lu).

Figure 11:
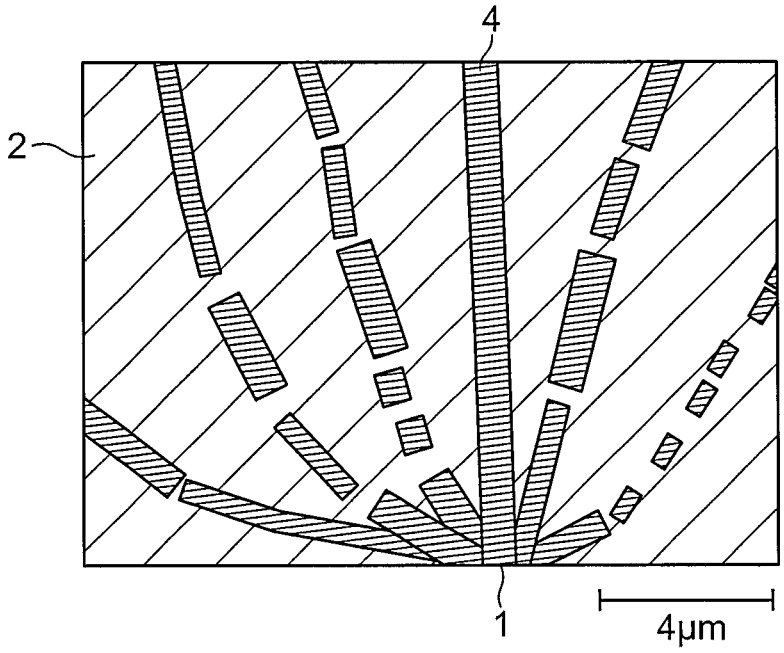
FIG. 11 is a schematic cross-sectional enlarged view showing the cross-sectional structure of a conventional R-T-B based alloy strip along the thickness direction.

The R-T-B based alloy strip of this embodiment does not have significant spread of the $R_2T_{14}B$ phase columnar crystals 2 in the direction perpendicular to the thickness direction (the left-right direction in FIG. 1), in a cross-section along the thickness direction as shown in FIG. 1, but instead they grow essentially uniformly in the thickness direction (the up-down direction in FIG. 1). Consequently, the widths of $R_2T_{14}B$ phase columnar crystals 2, i.e. the lengths M in the left-right direction, are smaller compared to a conventional R-T-B based alloy strip as shown in FIG. 11, and variation in the lengths M is reduced. The widths of the R-rich phase 4, i.e. the lengths in the left-right direction are also small, and variation in the lengths is reduced.

The R-T-B based alloy strip of this embodiment satisfies the following inequality (1), where $D_1$ and $D_2$ are, respectively, the average value for the lengths of the columnar crystals 2 on one (lower) surface side, in the direction perpendicular to the thickness direction of the R-T-B based alloy strip, i.e. the left-right direction in FIG. 1, and the average value for the lengths of the columnar crystals 2 on the other (upper) surface side, in the cross-section shown in FIG. 1.

$$0.9/1.1 \leq D_2/D_1 \leq 1.1/0.9 \quad (1)$$

Throughout the present specification, $D_1$, $D_2$ and $D_3$ are determined as follows. $D_3$ is the average value for the lengths of the center sections of the columnar crystals 2 in the direction perpendicular to the thickness direction of the R-T-B based alloy strip, in a cross-section as shown in FIG. 1.

First, a cross-section such as shown in FIG. 1 is observed by SEM (scanning electron microscope)-BEI (backscattered electron image) (magnification: 1000×). Photographs are taken of the cross-section in 15 visual fields, on one surface side of the R-T-B based alloy strip, on the other surface side which is the surface opposite the one surface, and on the center section. In the photographs, straight lines are drawn between a location 50 μm on the center section side from the one surface, a location 50 μm on the center section side from the other surface, and the center section. The straight lines are essentially parallel to the one surface and the other surface in the cross-section shown in FIG. 1. The values of $D_1$, $D_2$ and $D_3$ can be determined from the lengths of the straight lines and the number of columnar crystals 2 transected by the straight lines.

Since $D_2/D_1$ for the R-T-B based alloy strip of this embodiment satisfies formula (1) above, the widths and shapes of the columnar crystals 2 have low variation and high homogeneity in the thickness direction. From the viewpoint of further increasing the homogeneity, the value of $D_2/D_1$ preferably satisfies the following inequality (4) and more preferably satisfies the following inequality (5).

$$0.95/1.05 \leq D_2/D_1 \leq 1.05/0.95 \quad (4)$$

$$0.98/1.02 \leq D_2/D_1 \leq 1.02/0.98 \quad (5)$$

The R-T-B based alloy strip of this embodiment may be produced by a strip casting method using a cooling roll as described below. In this case, $R_2T_{14}B$ phase crystal nuclei 1 of the R-T-B based alloy strip are deposited on the contact surface with the cooling roll (the casting surface). The $R_2T_{14}B$ phase columnar crystals 2 grow in a radial fashion from the casting surface side of the R-T-B based alloy strip toward the side opposite the casting surface (the free surface). Thus, in the R-T-B based alloy strip shown in FIG. 1, the lower surface is the casting surface. In this case, $D_1$ is the average value for the lengths of the columnar crystals 2 on the casting surface side, and $D_2$ is the average value for the lengths of the columnar crystals 2 on the free surface side. In most cases, the relationship $D_2 \geq D_1$ applies.

When the relationship $D_2 \geq D_1$ applies for the R-T-B based alloy strip of this embodiment, the values of $D_1$ and $D_2$ preferably satisfy inequality (6) below. This allows the widths of the $R_2T_{14}B$ phase columnar crystals 2, i.e. the lengths M in the left-right direction, to be sufficiently small, and variation in the lengths M to be sufficiently reduced. It also allows an R-T-B based sintered magnet to be obtained having minimized segregation of the R-rich phase as well as increased homogeneity of the microstructure.

$$1 \leq D_2/D_1 \leq 1.1 \quad (6)$$

When $D_2 \geq D_1$, the lower limit for $D_2/D_1$ is preferably 1.01 and more preferably 1.02. The upper limit for $D_2/D_1$ is preferably 1.09 and more preferably 1.05.

The values of $D_1$, $D_2$ and $D_3$ are, for example, 1 to 4 μm, preferably 1.4 to 3.5 μm, and more preferably 1.5 to 3.2 μm. If the values of $D_1$, $D_2$ and $D_3$ are large, it will tend to be difficult to sufficiently micronize the alloy powder that is obtained by grinding. On the other hand, an R-T-B based alloy strip with excessively low values for $D_1$, $D_2$ and $D_3$, while maintaining columnar crystal shapes, will generally be difficult to produce.

The R-T-B based alloy strip of this embodiment preferably satisfies the following inequalities (2) and/or (3), where $D_{AVE}$ and $D_{MAX}$ are, respectively, the average value and maximum value for the lengths of the columnar crystals 2 in the direction perpendicular to the thickness direction, in the cross-section shown in FIG. 1.

$$1.0\ \mu m \leq D_{AVE} \leq 3.5\ \mu m \quad (2)$$

$$1.5\ \mu m \leq D_{MAX} \leq 4.5\ \mu m \quad (3)$$

Throughout the present specification, $D_{AVE}$ is the average value for $D_1$, $D_2$ and $D_3$ determined from the results of the aforementioned SEM-BEI image observation (magnification: 1000×). Thus, $D_{AVE}$ is the average value for the lengths of the columnar crystals 2 along the direction perpendicular to the thickness direction, over the entire cross-section shown in FIG. 1. Throughout the present specification, $D_{MAX}$ is the length of columnar crystals 2 in the photograph where the lengths of the columnar crystals 2 are at a maximum, among a total of 45 photographs taken for each of 15 visual fields, on the one surface side, the other surface side and the center section.

Specifically, inequality (2) specifies that the sizes (widths) of the columnar crystals 2 are in a prescribed range, and inequality (3) specifies that the variation in the sizes (widths) of the columnar crystals 2 is within a prescribed range. An R-T-B based alloy strip satisfying inequalities (2) and (3) is composed of columnar crystals 2 that are further micronized and have sufficiently reduced variation in shapes and sizes, and an R-rich phase 4 that is further micronized and has sufficiently reduced variation in shapes and sizes. Consequently, using alloy powder obtained by grinding such an R-T-B based alloy strip can yield an R-T-B based sintered magnet with further inhibited segregation of the R-rich phase and further increased microstructural homogeneity. If $D_{AVE}$ and $D_{MAX}$ are too small, ultrafine powder will increase during fine grinding, and the amount of oxygen will tend to increase. Also, chill crystals, which are equiaxial crystals, will also increase, and when a sintered magnet is formed the residual flux density (Br) will tend to be lowered.

From the viewpoint of obtaining an R-T-B based sintered magnet that is even more micronized and has a uniform structure, $D_{AVE}$ and $D_{MAX}$ preferably satisfy the following inequalities (7) and (8). The R-T-B based alloy strip will thus be one that can yield an R-T-B based sintered magnet having an even more micronized structure, while also facilitating production of the R-T-B based alloy strip.

$$1.0\ \mu m \leq D_{AVE} \leq 2.4\ \mu m \quad (7)$$

$$1.5\ \mu m \leq D_{MAX} \leq 3.0\ \mu m \quad (8)$$

From the viewpoint of obtaining an R-T-B based sintered magnet that has an even more micronized structure and facilitating production of the R-T-B based alloy strip, $D_{AVE}$ and $D_{MAX}$ preferably satisfy the following inequalities (9) and (10).

$$1.5\ \mu m \leq D_{AVE} \leq 2.4\ \mu m \quad (9)$$

$$2.0\ \mu m \leq D_{MAX} \leq 3.0\ \mu m \quad (10)$$

In the cross-section shown in FIG. 1, the proportion of the number of R-rich phases 4 with lengths of no greater than 1.5 μm in the direction perpendicular to the thickness direction, with respect to all of the R-rich phases 4, as phases with a high rare earth element concentration, is preferably 90% or greater, more preferably 93% or greater and even more preferably 95% or greater. By thus increasing the proportion of the number of R-rich phases 4 with lengths of no greater than 1.5 μm in the columnar crystals 2 in the R-T-B based alloy strip, it is possible to obtain an R-T-B based sintered magnet with even higher coercive force.

<Method for Producing R-T-B Based Alloy Strip>

Figure 2:
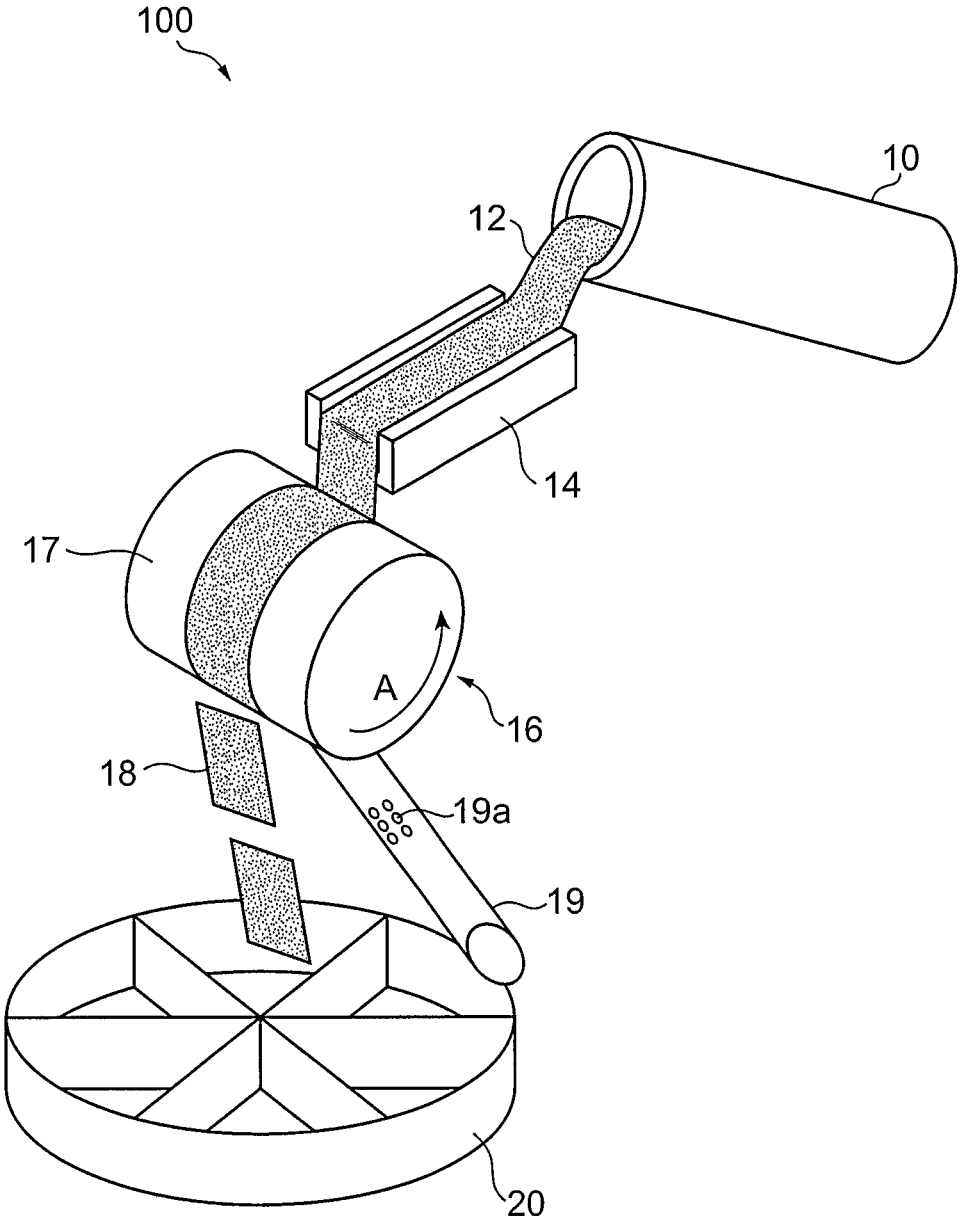
FIG. 2 is a schematic diagram showing an example of a method for producing an alloy strip according to the invention.

FIG. 2 is a schematic diagram of an apparatus for production of the R-T-B based alloy strip of this embodiment. The R-T-B based alloy strip of this embodiment may be produced by a strip casting method using a production apparatus such as shown in FIG. 2. The method for producing an alloy strip according to this embodiment comprises a melting step in which a molten R-T-B based alloy is prepared, a first cooling step in which the molten alloy is poured onto the roll surface of the cooling roll rotating in the circumferential direction, cooling the molten alloy by the roll surface to produce crystal nuclei, and solidifying at least a portion of the molten alloy, and a second cooling step in which the alloy containing crystal nuclei is further cooled to obtain an alloy strip. Each of these steps will now be explained in detail.

In the melting step, a starting material comprising at least one rare earth metal or rare earth alloy, or pure iron, ferroboron or an alloy thereof, is introduced into a high-frequency melting furnace 10. In the high-frequency melting furnace 10, the starting material is heated to 1300° C. to 1500° C. to prepare a molten alloy 12.

In the first cooling step, the molten alloy 12 is transferred to a tundish 14. Next, the molten alloy is poured from the tundish 14 onto the roll surface of the cooling roll 56 rotating at a prescribed speed in the direction of the arrow A. The molten alloy 12 contacts with the roll surface 17 of the cooling roll 16 and loses heat by heat exchange. As the molten alloy 12 cools, crystal nuclei are formed in the molten alloy and at least part of the molten alloy 12 solidifies. For example, a $R_2T_{14}B$ phase (melting temperature of about 1100° C.) is formed first, and then at least part of the R-rich phase (melting temperature of about 700° C.) solidifies. The crystal deposition is affected by the structure of the roll surface 17 with which the molten alloy 12 contacts. A concavoconvex pattern, comprising mesh-like recesses and raised sections formed by recesses, is formed on the roll surface 17 of the cooling roll 16.

Figure 3:
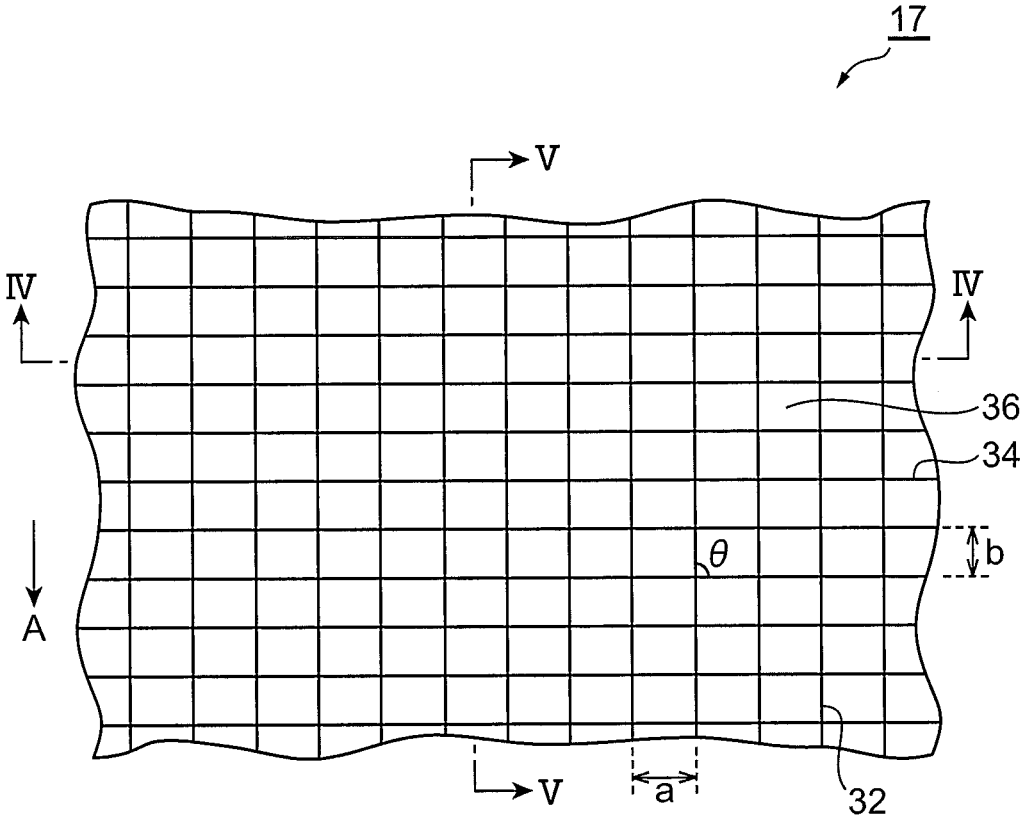
FIG. 3 is an enlarged plan view showing an example of the roll surface of a cooling roll used for production of an alloy strip according to the invention.

FIG. 3 is a schematic diagram showing a flat enlarged view of part of a roll surface 17. Mesh-like grooves are formed in the roll surface 17, and these form the concavoconvex pattern. Specifically, the roll surface 17 has a plurality of first recesses 32 arranged at a prescribed spacing a along the circumferential direction of the cooling roll 16 (the direction of the arrow A); and has a plurality of second recesses 34 arranged essentially perpendicular to the first recesses 32 and at a prescribed spacing b parallel to the axial direction of the cooling roll 16. The first recesses 32 and the second recesses 34 are essentially straight linear grooves having prescribed depths. Raised sections 36 are formed by the first recesses 32 and the second recesses 34.

The angle θ formed by the first recesses 32 and second recesses 34 is preferably 80-100° and more preferably 85-95°. By specifying such an angle θ, it will be possible for greater columnar growth of the crystal nuclei of the $R_2T_{14}B$ phase deposited on the raised sections 36 of the roll surface 17 to proceed toward the thickness direction of the alloy strip.

Figure 4:
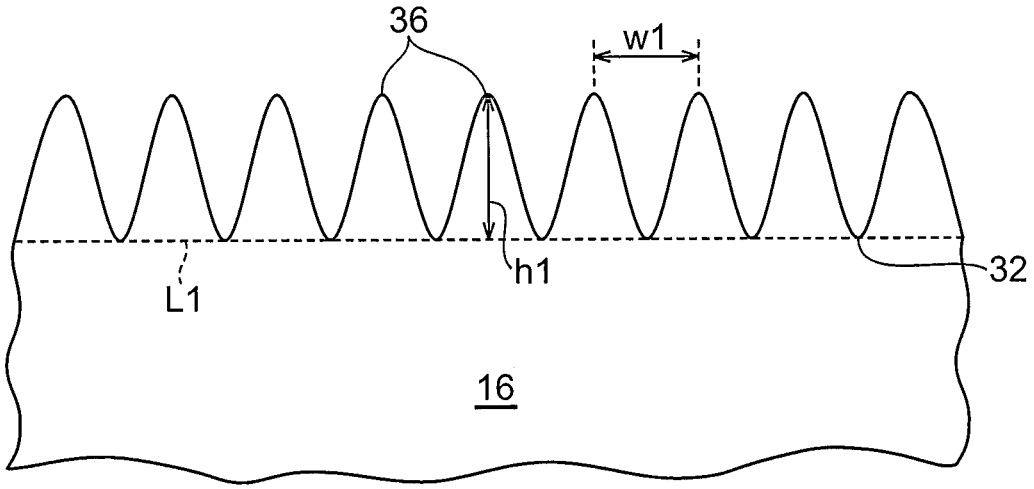
FIG. 4 is a schematic cross-sectional view showing an example of the cross-sectional structure near the roll surface of a cooling roll used for production of an alloy strip according to the invention.

FIG. 4 is a schematic enlarged cross-sectional view showing a cross-section of FIG. 3 along line Iv-Iv. Specifically, FIG. 4 is a schematic cross-sectional view showing a portion of the cross-sectional structure of a cooling roll 16 cut through the axis on a plane parallel to the axial direction. The heights h1 of the raised sections 36 can be calculated as the shortest distances between the apexes of the raised sections 36 and a straight line L1 passing through the bases of the first recesses 32 and parallel to the axial direction of the cooling roll 16, in the cross-section shown in FIG. 5. Also, the spacing w1 of the raised sections 36 can be calculated as the distance between apexes of adjacent raised sections 36, in the cross-section shown in FIG. 4.

Figure 5:
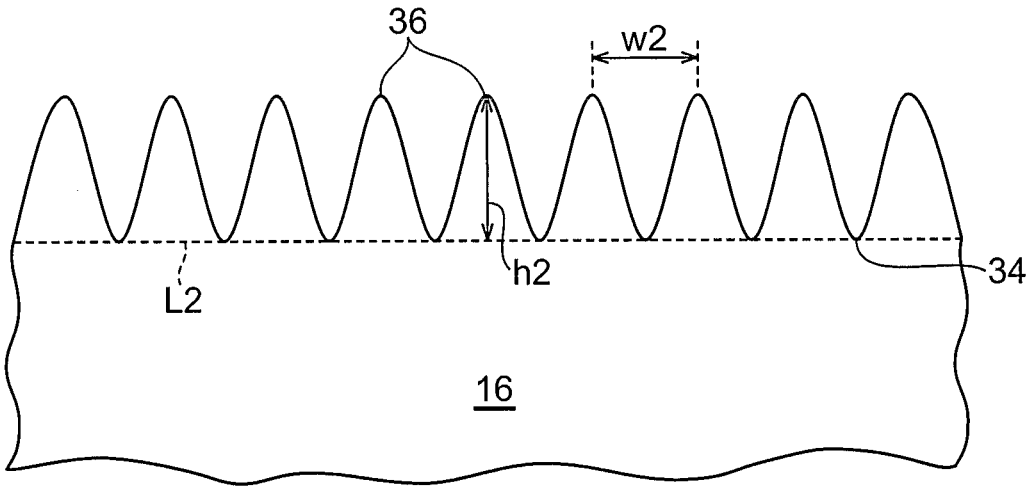
FIG. 5 is a schematic cross-sectional view showing an example of the cross-sectional structure near the roll surface of a cooling roll used for production of an alloy strip according to the invention.

FIG. 5 is a schematic enlarged cross-sectional view showing a cross-section of FIG. 3 along line V-V. Specifically, FIG. 5 is a schematic cross-sectional view showing a portion of the cross-sectional structure of a cooling roll 16 cut on a plane parallel to the side. The heights h2 of the raised sections 36 can be calculated as the shortest distances between the apexes of the raised sections 36 and a straight line L2 passing through the bases of the second recesses 34 and perpendicular to the axial direction of the cooling roll 16, in the cross-section shown in FIG. 5. Also, the spacing w2 of the raised sections 36 can be calculated as the distance between apexes of adjacent raised sections 36, in the cross-section shown in FIG. 5.

Throughout the present specification, the average value H of the heights of the raised sections 36 and the average value W of the spacing between raised sections 36 are calculated in the following manner. Using a laser microscope, a profile image (magnification: 200×) was taken of a cross-section of the cooling roll 16 near the roll surface 17, as shown in FIGS. 4 and 5. In these images, 100 points were measured for both heights h1 and heights h2 of arbitrarily selected raised sections 36. Here, measurement was made only for heights h1 and h2 that were 3 μm or greater, including no data for heights of less than 3 μm. The arithmetic mean value of measurement data for a total of 200 points was recorded as the average value for the heights of the raised sections 36.

Also, in the same image, 100 points were measured for both spacings w1 and spacings w2 of arbitrarily selected raised sections 36. Measurement of the spacings was conducted considering only heights h1 and h2 of 3 μm and greater as raised sections 36. The arithmetic mean value of measurement data for a total of 200 points was recorded as the average value W for the spacings of the raised sections 36. When it is difficult to observe a concavoconvex pattern on the roll surface 17 with a scanning electron microscope, a replica may be formed by replicating the concavoconvex pattern of the roll surface 17, and the surface of the replica observed with a scanning electron microscope and measured as described above. A replica can be formed using a commercially available kit (SUMP SET by Kenis, Ltd.).

The concavoconvex pattern of the roll surface 17 can be adjusted by working the roll surface 17 with a short wavelength laser, for example.

The average value H of the heights of the raised sections 36 is preferably 7 to 20 μm. This will cause the recesses 32, 34 to be thoroughly saturated with the molten alloy and allow adhesiveness between the molten alloy 12 and roll surface 17 to be sufficiently increased. The upper limit for the average value H is more preferably 16 μm and even more preferably 14 μm, from the viewpoint of more thoroughly saturating the recesses 32, 34 with the molten alloy. The lower limit for the average value H is more preferably 8.5 μm and even more preferably 8.7 μm, from the viewpoint of obtaining $R_2T_{14}B$ phase crystals with sufficiently high adhesiveness between the molten alloy and the roll surface 17, while also having more uniform orientation in the thickness direction of the alloy strip.

The average value W of the spacing between raised sections 36 is 40 to 100 μm. The upper limit for the average value W is preferably 80 μm, more preferably 70 μm and even more preferably 67 μm, from the viewpoint of further reducing the widths of the $R_2T_{14}B$ phase columnar crystals and obtaining magnet powder with a small particle diameter. The lower limit for the average value W is preferably 45 μm and more preferably 48 μm. This will allow an R-T-B based sintered magnet to be obtained having even higher magnetic properties.

The surface roughness Rz of the roll surface 17 is preferably 3 to 5 μm, more preferably 3.5 to 5 μm and even more preferably 3.9 to 4.5 μm. If Rz is too large the thickness of the strip will vary tending to increase variation in the cooling rate, whereas if Rz is too small, adhesiveness between the molten alloy and the roll surface 17 will be insufficient, and the molten alloy or alloy strip will tend to detach from the roll surface 17 earlier than the target time. In this case, the molten alloy migrates to the secondary cooling section 20 without sufficient progression of heat loss of the molten alloy. Therefore, the alloy strips 18 will sometimes stick together at the secondary cooling section 20.

The surface roughness Rz, for the purpose of the present specification, is the ten-point height of irregularities and is the value measured according to JIS B 0601-1994. Rz can be measured using a commercially available measuring apparatus (SURFTEST by Mitsutoyo Corp.).

For this embodiment, a cooling roll 16 having a roll surface 17 such as shown in FIGS. 3 to 5 is used, and therefore when the molten alloy 12 is poured onto the roll surface 17 of the cooling roll 16, the molten alloy 12 first contacts with the raised sections 36. Crystal nuclei 1 are generated at the contact sections, and the crystal nuclei 1 serve as origins for growth of $R_2T_{14}B$ phase columnar crystals 2. By increasing the number of crystal nuclei 1 per unit area by generation of numerous such crystal nuclei 1, it is possible to minimize growth of the columnar crystals 2 along the roll surface 17.

The cooling roll 16 and roll surface 17 have prescribed heights and have raised sections 36 arranged in a prescribed spacing. Numerous $R_2T_{14}B$ phase crystal nuclei 1 are generated on the roll surface 17, after which the columnar crystals 2 grow in a radial fashion with the crystal nuclei 1 as origins. During this time, growth of the columnar crystals 2 proceeds in the thickness direction of the R-T-B based alloy strip, forming $R_2T_{14}B$ phase columnar crystals 2 with small widths and low variation in width and shape, and R-rich phases 4 that are even more micronized and have sufficiently reduced variation in shape and size.

The cooling rate in the first cooling step is preferably 1000° C. to 3000° C./sec and more preferably 1500° C. to 2500° C./sec, from the viewpoint of adequately micronizing the structure of the obtained alloy strip while inhibiting generation of heterophases. If the cooling rate is below 1000° C./sec, an a-Fe phase will tend to be readily deposited, and if the cooling rate exceeds 3000° C./sec, chill crystals will tend to be readily deposited. Chill crystals are isotropic microcrystals with particle diameters of 1 μm and smaller. High generation of chill crystals tends to impair the magnetic properties of the finally obtained R-T-B based sintered magnet.

The cooling rate can be controlled, for example, by adjusting the temperature or flow rate of cooling water flowing through the interior of the cooling roll 16. The cooling rate can also be adjusted by varying the material of the roll surface 17 of the cooling roll 16. The material used for the cooling roll may be a copper sheet with a purity of 95 mass %, for example.

The second cooling step is a step in which the alloy strip 18 containing the crystal nuclei generated by the first cooling step is further cooled by a secondary cooling section 20. There are no particular restrictions on the cooling method in the second cooling step, and any conventional cooling method may be employed. For example, the secondary cooling section 20 may be one provided with a gas tube 19 having a gas blow hole 19*a*, wherein cooling gas is blown through the gas blow hole 19*a* onto the alloy strip accumulated on a rotating table rotating in the circumferential direction. The alloy strip 18 can be sufficiently cooled in this manner. The alloy strip is recovered after sufficient cooling with the secondary cooling section 20.

The thickness of the R-T-B based alloy strip of this embodiment is preferably no greater than 0.5 mm and more preferably 0.1 to 0.5 mm. If the thickness of the alloy strip becomes too large, the difference in cooling rate will tend to roughen the columnar crystal structure and impair the homogeneity. Also, the structure near the surface on the roll surface 17 side (the casting surface) and the structure near the surface on the side opposite the casting surface (the free surface) of the alloy strip will differ, and the difference between $D_1$ and $D_2$ will tend to increase.

The R-T-B based alloy strip of this embodiment comprises an $R_2T_{14}B$ phase as the main phase and an R-rich phase as the heterophase. Here, the main phase is the crystal phase most abundantly present in the alloy strip, while the heterophase is the crystal phase different from the main phase and is the crystal phase primarily present at the grain boundaries of the main phase. The R-rich phase is a phase that is non-magnetic and has a higher R content based on mass than the $R_2T_{14}B$ phase. The R-T-B based alloy strip of this embodiment may also contain an a-Fe phase and chill crystals in addition to the R-rich phase as the heterophase. However, the total heterophase content is preferably no greater than 10 mass %, more preferably no greater than 7 mass % and even more preferably no greater than 5 mass %, with respect to the total R-T-B based alloy strip. By thus reducing the total heterophase content, it is possible to obtain an R-T-B based sintered magnet with both excellent residual flux density and coercive force.

Figure 6:
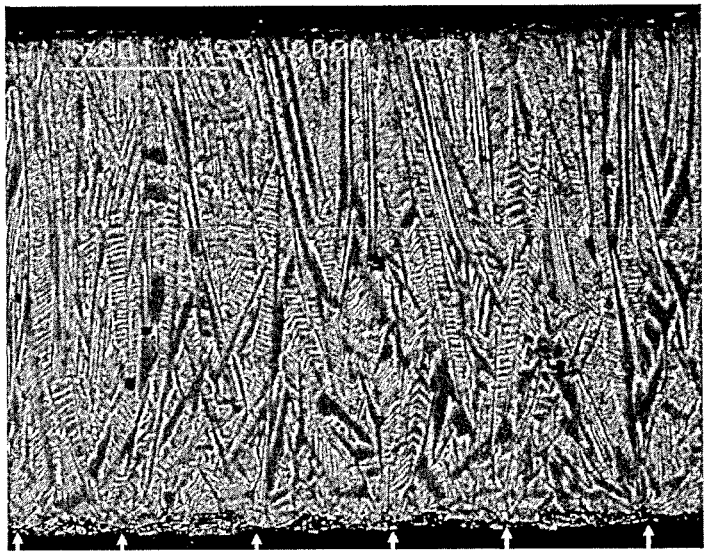
FIG. 6 is a SEM-BEI photograph (magnification: 350×) of a cross-section of an alloy strip according to an embodiment of the invention, along the thickness direction.
Figure 6:
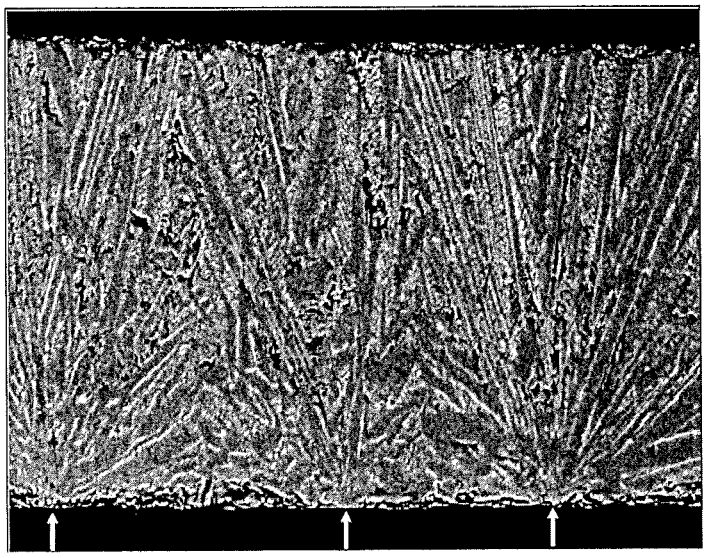

FIG. 6 is a SEM-BEI image photograph showing a cross-section of an R-T-B based alloy strip in the thickness direction. FIG. 6(A) is an SEM-BEI image photograph (magnification: 350×) showing a cross-section of the R-T-B based alloy strip of this embodiment in the thickness direction. Also, FIG. 6(B) is an SEM-BEI image photograph (magnification: 350×) showing a cross-section of a conventional R-T-B based alloy strip in the thickness direction. In FIGS. 6(A) and (B), the lower side surface of the R-T-B based alloy strip is the contact surface with the roll surface 17 (casting surface). Also, in FIGS. 6(A) and (B) the black sections represent $R_2T_{14}B$ phases and the white sections represent R-rich phases.

As shown in FIG. 6(A), the R-T-B based alloy strip of this embodiment has the crystal nuclei of numerous $R_2T_{14}B$ phases deposited on the lower surface (see the arrows in the drawing). In addition, $R_2T_{14}B$ phase columnar crystals extend in a radial fashion from the crystal nuclei in the upward direction of FIG. 6(A), i.e. along the thickness direction.

On the other hand, as shown in FIG. 6(B), a conventional R-T-B based alloy strip has less deposition of $R_2T_{14}B$ phase crystal nuclei than in FIG. 6(A). In addition, the $R_2T_{14}B$ phase crystals grow not only in the up-down direction but also in the left-right direction. Therefore, the lengths (widths) of the $R_2T_{14}B$ phase columnar crystals in the direction perpendicular to the thickness direction are increased compared to FIG. 6(A). If the R-T-B based alloy strip has such a structure, it will not be possible to obtain alloy powder that is micronized and has excellent homogeneity of shape and size.

<Method for Producing R-T-B Based Sintered Magnet>

A preferred embodiment of the method for producing an R-T-B based sintered magnet will now be described. The method for producing an R-T-B based sintered magnet according to this embodiment comprises a melting step in which a molten R-T-B based alloy is prepared, a first cooling step in which the molten alloy is poured onto the roll surface of the cooling roll rotating in the circumferential direction, cooling the molten alloy by the roll surface to produce crystal nuclei, and solidifying at least a portion of the molten alloy, and a second cooling step in which the alloy containing crystal nuclei is further cooled to obtain an R-T-B based alloy strip, a grinding step in which the R-T-B based alloy strip is ground to obtain an R-T-B based alloy powder, a molding step in which the alloy powder is molded to form a compact, and a firing step in which the compact is fired to obtain an R-T-B based sintered magnet. Specifically, the method for producing an R-T-B based sintered magnet according to this embodiment can be carried out using an R-T-B based alloy strip obtained by the aforementioned method for producing, in the same manner as the method for producing an alloy strip described above from the melting step through to the second cooling step. The steps from the grinding step onward will therefore now be explained.

There are no particular restrictions on the grinding method in the grinding step. The grinding can be carried out in the order of coarse grinding followed by fine grinding. Coarse grinding is preferably carried out in an inert gas atmosphere using, for example, a stamp mill, jaw crusher, Braun mill or the like. Hydrogen storage grinding may also be carried out, in which grinding is performed after hydrogen has been stored. By coarse grinding it is possible to prepare alloy powder with particle diameters of about several hundred μm. The alloy powder prepared by coarse grinding is subjected to fine grinding to a mean particle diameter of 1 to 5 μm, for example, using a jet mill or the like. Grinding of the alloy strip does not necessarily need to be carried out in two stages of coarse grinding and fine grinding, and may instead be carried out in a single step.

In the grinding step, the sections of the grain boundary phases 4 such as the alloy strip R-rich phase sections preferentially undergo fracturing. Consequently, the particle diameters of the alloy powder depend on the spacing of the heterophase 4. The alloy strip to be used in the method for producing for this embodiment has lower variation in widths M of the $R_2T_{14}B$ phase columnar crystals than in the prior art, as shown in FIG. 1, and therefore by grinding it is possible to obtain alloy powder having a small particle diameter and sufficiently reduced variation in size and shape.

In the molding step, the alloy powder is molded in a magnetic field to obtain a compact. Specifically, first the alloy powder is packed into a die situated in an electromagnet. A magnetic field is then applied by the electromagnet and the alloy powder is pressed while orienting the crystal axes of the alloy powder. Molding is thus carried out in a magnetic field to prepare a compact. The molding in a magnetic field may be carried out in a magnetic field of 12.0 to 17.0 kOe, for example, at a pressure of about 0.7 to 1.5 ton/cm$^2$.

In the firing step, the compact obtained by the magnetic field molding is fired in a vacuum or in an inert gas atmosphere to obtain a sintered compact. The firing conditions are preferably set as appropriate for the conditions including the composition, the grinding method and the particle size. For example, the firing temperature may be set to 1000° C. to 1100° C. for a firing time of 1 to 5 hours.

Since the R-T-B based sintered magnet obtained by the production method of this embodiment employs alloy powder comprising sufficiently micronized and highly homogeneous $R_2T_{14}B$ phase crystals and an R-rich phase, it can yield an R-T-B based sintered magnet with a more micronized and homogeneous structure than the prior art. Consequently, the production method of this embodiment allows production of an R-T-B based sintered magnet having sufficiently high coercive force while maintaining residual flux density.

The R-T-B based sintered magnet obtained by the process described above may also be subjected to aging treatment if necessary. By carrying out aging treatment, it is possible to further increase the coercive force of the R-T-B based sintered magnet. Aging treatment is preferably carried out in two stages, for example, under two different temperature conditions such as near 800° C. and near 600° C. Aging treatment under such conditions will tend to result in particularly excellent coercive force. When aging treatment is carried out in a single step, it is preferably at a temperature of near 600° C.

The R-T-B based sintered magnet obtained in this manner has the following composition, for example. Specifically, the R-T-B based sintered magnet comprises R, B, Al, Cu, Zr, Co, O, C and Fe, the content ratio of each of the elements being R: 25 to 37 mass %, B: 0.5 to 1.5 mass %, Al: 0.03 to 0.5 mass %, Cu: 0.01 to 0.3 mass %, Zr: 0.03 to 0.5 mass %, Co: ≤3 mass % (not including 0 mass %), O: ≤0.5 mass % and Fe: 60 to 72 mass %. The composition of the R-T-B based sintered magnet will usually be the same as the composition of the R-T-B alloy strip.

The R-T-B based sintered magnet may contain about 0.001 to 0.5 mass % of unavoidable impurities such as Mn, Ca, Ni, Si, Cl, S and F, in addition to the elements mentioned above. However, the content of these impurities is preferably less than 2 mass % and more preferably less than 1 mass % in total.

The R-T-B based sintered magnet comprises an $R_2T_{14}B$ phase as the main phase and an R-rich phase as the heterophase. Since the R-T-B based sintered magnet is obtained using alloy powder with a small particle diameter and low variation in particle diameter, it has increased structural homogeneity and sufficiently excellent coercive force.

Figure 7:
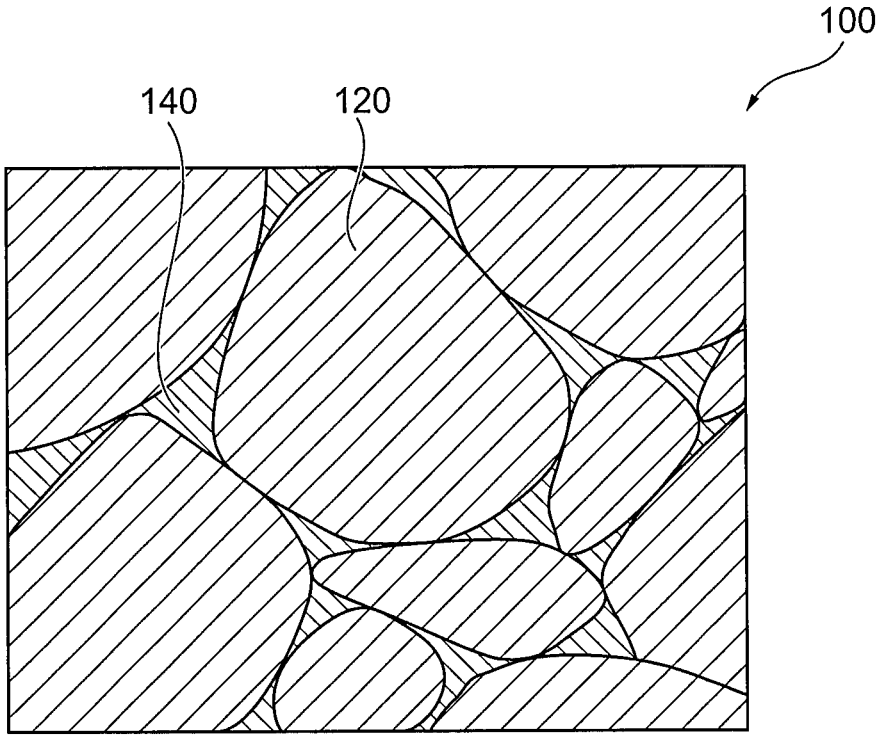
FIG. 7 is a cross-sectional view schematically showing an example of the cross-sectional structure of an R-T-B based sintered magnet according to an embodiment of the invention.

FIG. 7 is a schematic cross-sectional enlarged view showing a portion of a cross-section of the R-T-B based sintered magnet of this embodiment. The R-T-B based sintered magnet 100 preferably comprises at least Fe as a transition element (T), and more preferably it comprises a combination of Fe and a transition element other than Fe. Transition elements other than Fe include Co, Cu and Zr.

The R-T-B based sintered magnet 100 preferably comprises at least one element selected from among Al, Cu, Ga, Zn and Ge. This will allow an R-T-B based sintered magnet 100 to be obtained with even higher coercive force. The R-T-B based sintered magnet 100 also preferably comprises at least one element selected from among Ti, Zr, Ta, Nb, Mo and Hf. By including such elements it is possible to suppress grain growth during firing, and further increase the coercive force of the R-T-B based sintered magnet 100.

The rare earth element content of the R-T-B based sintered magnet 100 is preferably 25 to 37 mass % and more preferably 28 to 35 mass %, from the viewpoint of further increasing the magnetic properties. The B content of the R-T-B based sintered magnet 100 is preferably 0.5 to 1.5 mass % and more preferably 0.7 to 1.2 mass %.

The rare earth elements include one or more elements selected from among scandium (Sc), yttrium (Y), lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) and lutetium (Lu).

The R-T-B based sintered magnet 100 may also contain a heavy rare earth element such as Dy, Tb or Ho as a rare earth element. In this case, the content of heavy rare earth elements in the total mass of the R-T-B based sintered magnet 100 is preferably no greater than 1.0 mass %, more preferably no greater than 0.5 mass % and even more preferably no greater than 0.1 mass %, as the total of the heavy rare earth elements. With the R-T-B based sintered magnet 100 of this embodiment, it is possible to obtain high coercive force even with such a low heavy rare earth element content.

If the rare earth element content is less than 25 mass %, the amount of production of the $R_2T_{14}B$ phase as the main phase of the R-T-B based sintered magnet 100 will be reduced, α-Fe and the like having soft magnetism will be deposited more readily, and HcJ may potentially be reduced. If it is greater than 37 mass %, on the other hand, potentially the volume ratio of the $R_2T_{14}B$ phase may be reduced and the residual flux density lowered.

From the viewpoint of further increasing the coercive force, the R-T-B based sintered magnet 100 preferably contains a total of 0.2 to 2 mass % of at least one type of element selected from among Al, Cu, Ga, Zn and Ge. From the same viewpoint, the R-T-B based sintered magnet 100 also preferably comprises a total of 0.1 to 1 mass % of at least one element selected from among Ti, Zr, Ta, Nb, Mo and Hf.

The content of transition elements (T) in the R-T-B based sintered magnet 100 is the remainder after the aforementioned rare earth elements, boron and added elements.

When Co is included as a transition element, the content is preferably no greater than 3 mass % (not including 0), and more preferably 0.3 to 1.2 mass %. Co forms a phase similar to Fe, and including Co can increase the Curie temperature and corrosion resistance of the grain boundary phase.

The oxygen content of the R-T-B based sintered magnet 100 is preferably 300-3000 ppm and more preferably 500-1500 ppm, from the viewpoint of achieving high levels for both magnetic properties and corrosion resistance. The nitrogen content of the R-T-B based sintered magnet 100 is 200 to 1500 ppm and preferably 500 to 1500 ppm, from the same viewpoint explained above. The carbon content of the R-T-B based sintered magnet 100 is 500 to 3000 ppm and preferably 800 to 1500 ppm, from the same viewpoint explained above.

The crystal grains 120 of the R-T-B based sintered magnet 100 preferably comprise an $R_2T_{14}B$ phase. On the other hand, the triple point regions 140 include a phase with a higher R content ratio than the $R_2T_{14}B$ phase, based on mass compared to the $R_2T_{14}B$ phase. The average value of the area of the triple point regions 140 in a cross-section of the R-T-B based sintered magnet 100 is no greater than 2 $\mu m^2$ and preferably no greater than 1.9 $\mu m^2$, as the arithmetic mean. Also, the standard deviation for the area distribution is no greater than 3 and preferably no greater than 2.6. Since the R-T-B based sintered magnet 100 thus has minimal segregation of the phase with a higher R content than the $R_2T_{14}B$ phase, the area of the triple point regions 140 is low and the variation in area is also reduced. It is thus possible to maintain high levels for both Br and HcJ.

The average value for the area of the triple point regions 140 in the cross-section, and the standard deviation for the area distribution, can be calculated in the following manner. First, the R-T-B based sintered magnet 100 is cut and the cut surface is polished. The polished surface image is observed with a scanning electron microscope. Image analysis is performed and the area of the triple point regions 140 is calculated. The arithmetic mean value for the calculated area is the mean area. Also, the standard deviation for the area of the triple point regions 140 can be calculated based on the area of each of the triple point regions 140 and their average value.

The rare earth element content in the triple point regions 140 is preferably 80 to 99 mass %, more preferably 85 to 99 mass % and even more preferably 90 to 99 mass %, from the viewpoint of obtaining an R-T-B based sintered magnet with sufficiently high magnetic properties and sufficiently excellent corrosion resistance. From the same viewpoint, the rare earth element contents of each of the triple point regions 140 are preferably equal. Specifically, the standard deviation for the content distribution in the triple point regions 140 of the R-T-B based sintered magnet 100 is preferably no greater than 5, preferably no greater than 4 and more preferably no greater than 3.

The mean particle diameter for the crystal grains 120 of the R-T-B based sintered magnet 100 is preferably 0.5 to 5 μm and more preferably 2 to 4.5 from the viewpoint of further increasing the magnetic properties. The mean particle diameter can be calculated by performing image processing of the electron microscope image of a cross-section of the R-T-B based sintered magnet 100, measuring the particle diameters of the individual crystal grains 120, and taking the arithmetic mean of the measured values.

The R-T-B based sintered magnet 100 comprises dendritic crystal grains 2 containing a $R_2T_{14}B$ phase, and grain boundary regions 4 containing a phase with a higher R content than the $R_2T_{14}B$ phase, and preferably it is obtained by molding and firing a ground product of an R-T-B based alloy strip having an average value of no greater than 3 μm for the spacing between the phases with a higher R content than the $R_2T_{14}B$ phase in a cross-section. Since such an R-T-B based sintered magnet 100 is obtained using a ground product that is sufficiently micronized and has a sharp particle size distribution, it is possible to obtain an R-T-B based sintered compact composed of fine crystal grains. In addition, since the phase with a higher R content than the $R_2T_{14}B$ phase will be present in a higher proportion at the outer periphery than in the interior of the ground product, the state of dispersion of the phase with a higher R content than the $R_2T_{14}B$ phase after sintering will tend to be more satisfactory. Thus, the structure of the R-T-B based sintered compact will be micronized and the homogeneity will be improved. It will thereby be possible to further increase the magnetic properties of the R-T-B based sintered compact.

Figure 8:
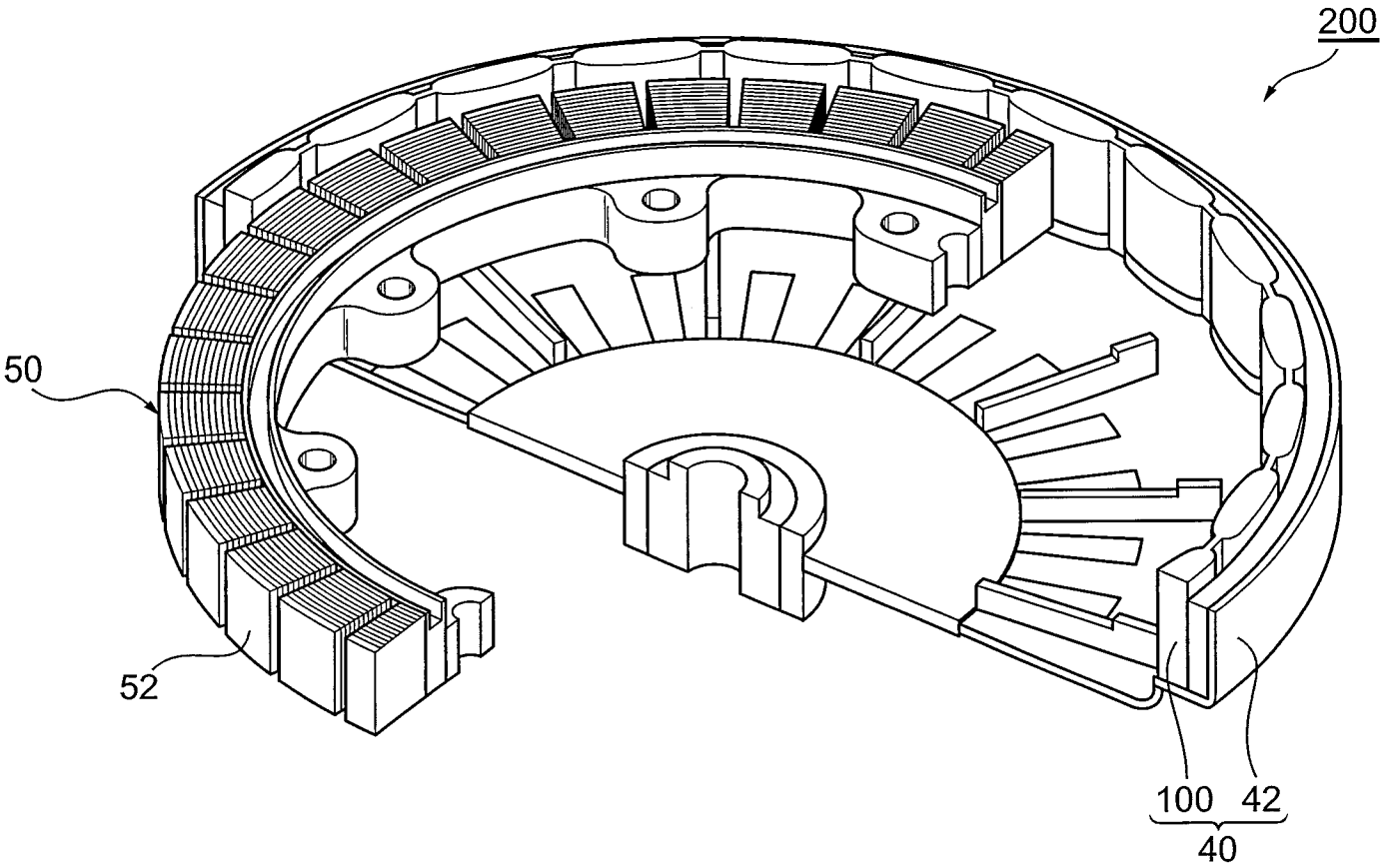
FIG. 8 is an illustration showing the internal structure of a motor comprising an R-T-B based sintered magnet according to an embodiment of the invention.

FIG. 8 is an illustration showing the internal structure of a motor comprising an R-T-B based sintered magnet 100 obtained by the production method described above. The motor 200 shown in FIG. 8 is a permanent magnet synchronous motor (SPM motor 200), comprising a cylindrical rotor 40 and a stator 50 situated on the inside of the rotor 40. The rotor 40 has a cylindrical core 42 and a plurality of R-T-B based sintered magnets 100 oriented with the N-poles and S-poles alternating along the inner peripheral surface of the cylindrical core 42. The stator 50 has a plurality of coils 52 provided along the outer peripheral surface. The coils 52 and R-T-B based sintered magnets 100 are arranged in a mutually opposing fashion.

The SPM motor 200 is provided with an R-T-B based sintered magnet 100 in the rotor 40. The R-T-B based sintered magnet 100 exhibits high levels in terms of both high magnetic properties and excellent corrosion resistance. Thus, the SPM motor 200 comprising the R-T-B based sintered magnet 100 can continuously exhibit high output for prolonged periods.

The embodiment described above is only a preferred embodiment of the invention, and the invention is in no way limited thereto. For example, the R-T-B based alloy strip of this embodiment had the crystal nuclei 1 of the $R_2T_{14}B$ phase only on one side, but it may also have the crystal nuclei 1 on the other side of the R-T-B based alloy strip. In this case, both sides have crystal nuclei 1 such as shown in FIG. 1, and the columnar crystals 2 of the $R_2T_{14}B$ phase extend in a radial fashion along the thickness direction from each of the crystal nuclei 1. Thus, an R-T-B based alloy strip having crystal nuclei 1 on both sides can be obtained by a twin-roll casting method in which two cooling rolls having the aforementioned concavoconvex pattern are aligned and molten alloy is cast between them.

EXAMPLES

The nature of the invention will now be further explained through the following examples and comparative examples. However, the invention is not limited to the examples described below.

Example 1

<Fabrication of Alloy Strip>

An apparatus for production of an alloy strip as shown in FIG. 2 was used for a strip casting method by the following procedure. First, the starting compounds for each of the constituent elements were added so that the composition of the alloy strip had the elemental ratios (mass %) shown in Table 2, and heated to 1300° C. with a high-frequency melting furnace 10, to prepare a molten alloy 12 having an R-T-B based composition. The molten alloy 12 was poured onto the roll surface 17 of the cooling roll 16 rotating at a prescribed speed through a tundish. The cooling rate of the molten alloy 12 on the roll surface 17 was 1800° C. to 2200° C./sec.

The roll surface 17 of the cooling roll 16 had a concavoconvex pattern comprising straight linear first recesses 32 extending along the rotational direction of the cooling roll 16, and straight linear second recesses 34 perpendicular to the first recesses 32. The average value H for the heights of the raised sections 36, the average value W for the spacings between the raised sections 36, and the surface roughness Rz, were as shown in Table 1. Measurement of the surface roughness Rz was carried out using a measuring apparatus by Mitsutoyo Corp. (trade name: SURFTEST).

The alloy strip obtained by cooling with the cooling roll 16 was further cooled with a secondary cooling section 20 to obtain an alloy strip having an R-T-B based composition. The composition of the alloy strip was as shown in Table 2.

<Evaluation of Alloy Strip>

A SEM-BEI photograph was taken of a cross-section along the thickness direction of the obtained alloy strip (magnification: 350×). The thickness of the alloy strip was determined from the photograph. The thickness was as shown in Table 1.

In addition, SEM-BEI image photographs of cross-sections along the thickness direction of the alloy strip were for 15 visual fields on the casting surface side, the free surface side and at the center section, for a total of 45 SEM-BEI photographs (magnification: 1000×). Using the photographs, 0.15 mm straight lines were drawn to a position 50 μm on the center section side from the casting surface, a position 50 μm on the center section side from the free surface, and to the center section. The values of $D_1$, $D_2$ and $D_3$ were determined from the length of the straight line and the number of columnar crystals transected by the straight line.

Incidentally, $D_1$ is the average value for the lengths of the columnar crystals on the casting surface side in the direction perpendicular to the thickness direction, $D_2$ is the average value for the lengths of the columnar crystals on the free surface side in the direction perpendicular to the thickness direction, and $D_3$ is the average value for the lengths of the columnar crystal at the center section in the direction perpendicular to the thickness direction. The average value $D_{AVE}$ was calculated for $D_1$, $D_2$ and $D_3$. In addition, the maximum for the lengths of the columnar crystals in the direction perpendicular to the thickness direction in the 45 photographs was recorded as $D_{MAX}$. The measurement results were as shown in Table 1.

Also, the 45 SEM-BEI image photographs were used to determine the percentage of the number of R-rich phases with lengths of up to 1.5 μm on the straight line, with respect to the total number of R-rich phases through which the straight line crossed. The results were as shown in Table 1.

<Fabrication of R-T-B Based Sintered Magnet>

The alloy strip was then ground to obtain alloy powder with a mean particle diameter of 2.0 μm. The alloy powder was packed into a die situated in an electromagnet, and molded in a magnetic field to produce a compact. The molding was accomplished by pressing at 1.2 ton/cm$^2$ while applying a magnetic field of 15 kOe. The compact was then fired at 930° C. to 1030° C. for 4 hours in a vacuum and rapidly cooled to obtain a sintered compact. The obtained sintered compact was subjected to two-stage aging treatment at 800° C. for 1 hour and at 540° C. for 1 hour (both in an argon gas atmosphere), to obtain an R-T-B based sintered magnet for Example 1.

<Evaluation of R-T-B Based Sintered Magnet>

A B-H tracer was used to measure the Br (residual flux density) and HcJ (coercive force) of the obtained R-T-B based sintered magnet. The measurement results are shown in Table 1.

Examples 2 to 6, Examples 16 to 18

Figure 9:
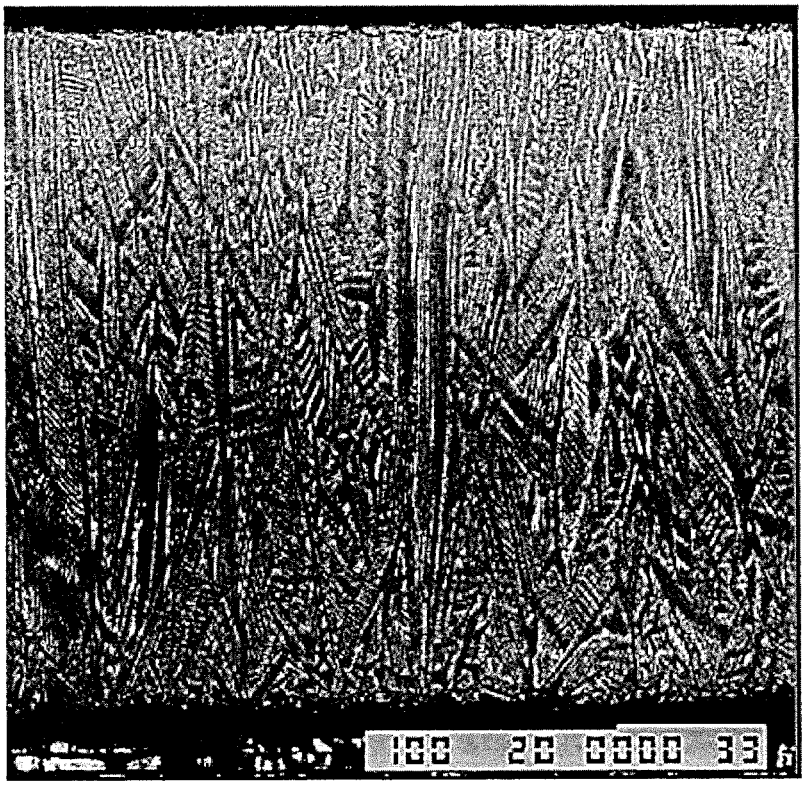
FIG. 9 is an SEM-BEI photograph (magnification: 350×) of a cross-section of the R-T-B based alloy strip of Example 5, along the thickness direction.

Alloy strips for Examples 2 to 6 and Examples 16 to 18 were obtained in the same manner as Example 1, except that the roll surface of a cooling roll was worked to change the average value H for the heights of the raised sections, the average value W for the spacings between the raised sections and the surface roughness Rz, as shown in Table 1. The alloy strips of Examples 2 to 6 and Examples 16 to 18 were also evaluated in the same manner as Example 1. R-T-B based sintered magnets for Examples 2 to 6 and Examples 16 to 18 were fabricated in the same manner as Example 1, and evaluated. The results are shown in Table 1. FIG. 9 is an SEM-BEI photograph (magnification: 350×) of a cross-section of the R-T-B based alloy strip of Example 5, along the thickness direction.

Examples 7 to 15 and Examples 19 to 31

Alloy strips for Examples 7 to 15 and Examples 19 to 31 were obtained in the same manner as Example 1, except that the roll surface of a cooling roll was worked to change the average value for the heights of the raised sections, the average value for the spacings between the raised sections and the surface roughness Rz, as shown in Table 1, and the starting materials were changed to the compositions of the alloy strip as shown in Table 2. The alloy strips of Examples 7 to 15 and Examples 19 to 31 were also evaluated in the same manner as Example 1. Also, R-T-B based sintered magnets for Examples 7 to 15 and Examples 19 to 31 were fabricated in the same manner as Example 1, and evaluated. The results are shown in Table 1.

Comparative Example 1

R-T-B based alloy strips for Comparative Example 1 and Comparative Example 2 were obtained in the same manner as Example 1, except that there were used cooling rolls having on the roll surface only straight linear first recesses extending in the rotational direction of the roll. These cooling rolls did not have second recesses. The average value H for the heights of the raised sections, the average value W for the spacings between the raised sections and the surface roughness Rz, for the cooling rolls, were determined in the following manner. Specifically, the cross-sectional structure near the roll surface was observed with a scanning electron microscope at the cut surface, when the cooling roll was cut on a plane parallel to the axial direction running through the axis of the cooling roll. The average value H for the heights of the raised sections is the arithmetic mean value for the heights of 100 raised sections, and the average value W for the spacings between the raised sections is the arithmetic mean value for the values of spacings between adjacent raised sections measured at 100 different locations.

The alloy strip of Comparative Example 1 was evaluated in the same manner as Example 1. An R-T-B based sintered magnet for Comparative Example 1 was fabricated in the same manner as Example 1 and evaluated. The results are shown in Table 1.

Comparative Examples 2 and 3

Figure 10:
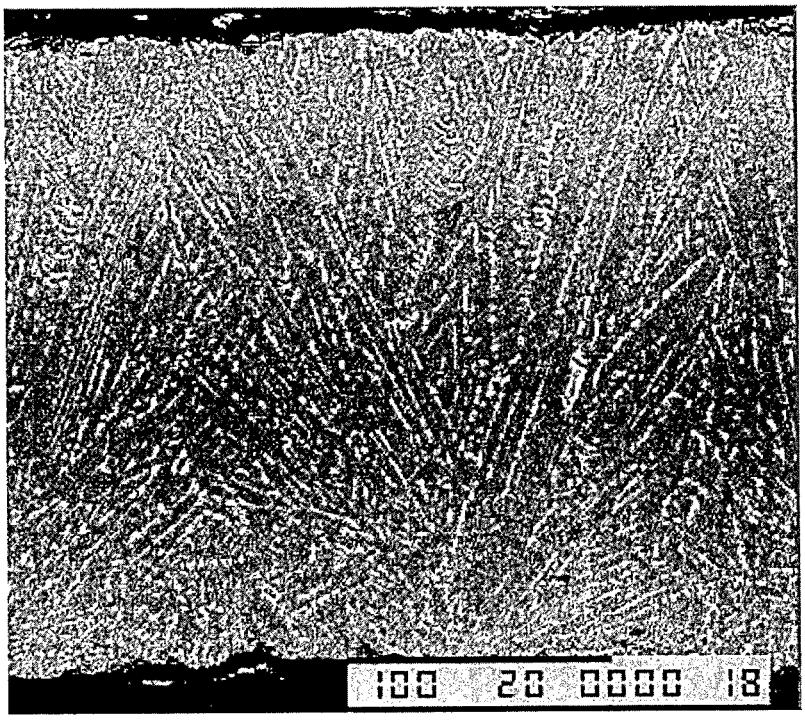
FIG. 10 is an SEM-BEI photograph (magnification: 350×) of a cross-section of the R-T-B based alloy strip of Comparative Example 3, along the thickness direction.

R-T-B based alloy strips for Comparative Examples 2 and 3 were obtained in the same manner as Example 1, except that the roll surface of a cooling roll was worked to change the average value H for the heights of the raised sections, the average value W for the spacings between the raised sections and surface roughness Rz, as shown in Table 1. The R-T-B based alloy strips of Comparative Examples 2 and 3 were also evaluated in the same manner as Example 1. R-T-B based sintered magnets for Comparative Examples 2 and 3 were fabricated in the same manner as Example 1 and evaluated. The results are shown in Table 1. FIG. 10 is an SEM-BEI photograph (magnification: 350×) of a cross-section of the R-T-B based alloy strip of Comparative Example 3, along the thickness direction.

Comparative Example 4

An R-T-B based alloy strip was obtained for Comparative Example 4 in the same manner as Example 1, except that there were used cooling rolls having only straight linear first recesses on the roll surfaces extending in the rotational direction of the rolls, and the starting materials were changed to the composition of the alloy strip as shown in Table 2. These cooling rolls did not have second recesses. The average value H for the heights of the raised sections, the average value W for the spacings between the raised sections and the surface roughness Rz, for the cooling rolls, were determined in the same manner as Comparative Example 1.

The alloy strip of Comparative Example 4 was evaluated in the same manner as Example 1. An R-T-B based sintered magnet for Comparative Example 4 was fabricated in the same manner as Example 1 and evaluated. The results are shown in Table 1.

TABLE 1

| | Cold roll surface | | | | Alloy strip | Cross section along thickness direction of alloy strip | | | | |
|---|---|---|---|---|---|---|---|---|---|---|
| | Concavoconvex pattern | Surface roughness (Rz μm | Raised section height (mean value H) μm | Raised section spacing (mean value W) μm | Thickness mm | $D_{AVE}$ μm | $D_{MAX}$ μm | $D_1$ μm | $D_2$ μm | $D_3$ μm |
| Example 1 | perpendicular | 4.2 | 7.0 | 66.0 | 0.30 | 2.95 | 3.91 | 2.96 | 3.05 | 2.84 |
| Example 2 | perpendicular | 4.5 | 9.0 | 64.0 | 0.29 | 2.47 | 3.23 | 2.45 | 2.54 | 2.43 |
| Example 3 | perpendicular | 3.9 | 11.6 | 60.0 | 0.27 | 2.36 | 2.75 | 2.30 | 2.42 | 2.37 |
| Example 4 | perpendicular | 4.1 | 11.6 | 57.0 | 0.25 | 2.17 | 2.81 | 2.14 | 2.19 | 2.17 |
| Example 5 | perpendicular | 4.4 | 13.0 | 54.0 | 0.23 | 2.00 | 2.59 | 1.97 | 2.00 | 2.04 |
| Example 6 | perpendicular | 4.5 | 14.0 | 48.0 | 0.18 | 1.76 | 2.18 | 1.67 | 1.84 | 1.76 |
| Example 7 | perpendicular | 4.3 | 8.5 | 65.0 | 0.23 | 2.05 | 2.45 | 1.95 | 2.12 | 2.08 |
| Example 8 | perpendicular | 4.2 | 8.7 | 63.0 | 0.23 | 1.77 | 2.19 | 1.69 | 1.85 | 1.77 |
| Example 9 | perpendicular | 4.4 | 9.2 | 67.0 | 0.23 | 1.56 | 1.94 | 1.49 | 1.63 | 1.55 |
| Example 10 | perpendicular | 4.4 | 10.2 | 62.0 | 0.26 | 2.36 | 3.03 | 2.23 | 2.42 | 2.42 |
| Example 11 | perpendicular | 4.5 | 10.6 | 64.0 | 0.24 | 2.41 | 3.14 | 2.28 | 2.48 | 2.48 |
| Example 12 | perpendicular | 4.3 | 10.4 | 58.0 | 0.25 | 2.28 | 2.90 | 2.17 | 2.35 | 2.31 |
| Example 13 | perpendicular | 4.3 | 9.9 | 57.0 | 0.23 | 2.32 | 2.88 | 2.21 | 2.43 | 2.33 |
| Example 14 | perpendicular | 4.4 | 9.8 | 65.0 | 0.27 | 2.68 | 3.34 | 2.56 | 2.80 | 2.68 |
| Example 15 | perpendicular | 4.4 | 10.7 | 57.0 | 0.23 | 2.22 | 2.78 | 2.12 | 2.30 | 2.23 |
| Example 16 | perpendicular | 4.6 | 6.8 | 66.0 | 0.30 | 2.95 | 3.81 | 2.80 | 3.08 | 2.96 |
| Example 17 | perpendicular | 4.7 | 14.2 | 47.0 | 0.17 | 1.50 | 1.92 | 1.48 | 1.50 | 1.53 |
| Example 18 | perpendicular | 4.4 | 7.2 | 65.0 | 0.30 | 2.90 | 3.72 | 2.81 | 3.04 | 2.84 |
| Example 19 | perpendicular | 4.2 | 6.8 | 65.0 | 0.31 | 3.08 | 3.98 | 2.96 | 3.14 | 3.09 |
| Example 20 | perpendicular | 4.2 | 7.0 | 68.0 | 0.30 | 3.10 | 3.91 | 2.99 | 3.20 | 3.08 |
| Example 21 | perpendicular | 4.3 | 6.9 | 66.0 | 0.29 | 2.98 | 3.91 | 2.88 | 3.09 | 3.00 |
| Example 22 | perpendicular | 4.2 | 7.0 | 67.0 | 0.31 | 3.03 | 4.12 | 2.88 | 3.14 | 2.96 |
| Example 23 | perpendicular | 4.1 | 7.1 | 64.0 | 0.30 | 3.10 | 4.09 | 2.93 | 3.12 | 3.10 |
| Example 24 | perpendicular | 4.2 | 7.0 | 65.0 | 0.30 | 2.99 | 3.90 | 2.84 | 3.10 | 2.96 |
| Example 25 | perpendicular | 4.2 | 7.2 | 66.0 | 0.30 | 2.95 | 3.80 | 2.82 | 3.02 | 2.94 |
| Example 26 | perpendicular | 4.3 | 6.9 | 66.0 | 0.31 | 3.03 | 3.99 | 2.90 | 3.15 | 2.98 |
| Example 27 | perpendicular | 4.2 | 7.1 | 67.0 | 0.28 | 2.90 | 3.95 | 2.84 | 3.10 | 3.02 |
| Example 28 | perpendicular | 4.2 | 6.8 | 65.0 | 0.30 | 3.13 | 4.11 | 3.00 | 3.29 | 3.02 |
| Example 29 | perpendicular | 4.2 | 7.2 | 68.0 | 0.30 | 3.09 | 3.95 | 2.96 | 3.22 | 3.02 |
| Example 30 | perpendicular | 4.1 | 7.0 | 66.0 | 0.32 | 3.35 | 4.46 | 3.19 | 3.48 | 3.35 |
| Example 31 | perpendicular | 4.2 | 7.1 | 67.0 | 0.29 | 3.23 | 3.37 | 3.11 | 3.39 | 3.27 |
| Comp. Ex. 1 | Rotating direction | 2.9 | 5.8 | 126.1 | 0.29 | 4.32 | 5.52 | 4.02 | 4.57 | 4.38 |
| Comp. Ex. 2 | perpendicular | 5.8 | 16.9 | 35.0 | 0.31 | 4.78 | 6.23 | *1 | 4.66 | 5.12 |
| Comp. Ex. 3 | perpendicular | 3.2 | 6.7 | 69.5 | 0.19 | 4.10 | 5.26 | 3.70 | 4.39 | 4.21 |
| Comp. Ex. 4 | Rotating direction | 2.8 | 5.3 | 132.0 | 0.33 | 4.78 | 6.03 | 4.38 | 5.07 | 4.88 |

| | $D_2/D_1$ | Percentage of number of R-rich phases ≤1.5 μm % | Magnetic properties Br (kG) | Hcj (kOe) |
|---|---|---|---|---|
| Example 1 | 1.03 | 91 | 14.0 | 16.4 |
| Example 2 | 1.03 | 93 | 14.1 | 16.7 |
| Example 3 | 1.05 | 95 | 13.9 | 17.5 |
| Example 4 | 1.02 | 95 | 13.9 | 18.1 |
| Example 5 | 1.02 | 97 | 13.8 | 18.8 |
| Example 6 | 1.10 | 93 | 13.7 | 16.7 |
| Example 7 | 1.09 | 93 | 13.8 | 17.5 |
| Example 8 | 1.09 | 93 | 13.0 | 19.8 |
| Example 9 | 1.09 | 94 | 12.6 | 20.6 |
| Example 10 | 1.09 | 93 | 13.9 | 16.5 |
| Example 11 | 1.09 | 93 | 14.0 | 16.7 |
| Example 12 | 1.08 | 94 | 14.1 | 16.4 |
| Example 13 | 1.10 | 92 | 14.0 | 16.3 |
| Example 14 | 1.09 | 91 | 14.4 | 14.8 |
| Example 15 | 1.08 | 94 | 13.2 | 18.2 |
| Example 16 | 1.10 | 91 | 14.4 | 15.0 |
| Example 17 | 1.01 | 98 | 13.5 | 18.0 |
| Example 18 | 1.08 | 91 | 14.4 | 15.4 |
| Example 19 | 1.06 | 92 | 14.0 | 16.6 |
| Example 20 | 1.07 | 91 | 14.0 | 17.1 |
| Example 21 | 1.07 | 93 | 13.9 | 19.1 |
| Example 22 | 1.09 | 91 | 13.9 | 18.7 |
| Example 23 | 1.06 | 91 | 14.4 | 15.1 |
| Example 24 | 1.09 | 92 | 14.4 | 18.3 |
| Example 25 | 1.07 | 88 | 14.5 | 17.1 |
| Example 26 | 1.09 | 91 | 14.4 | 18.0 |
| Example 27 | 1.09 | 90 | 13.5 | 17.9 |
| Example 28 | 1.10 | 92 | 14.6 | 15.5 |
| Example 29 | 1.09 | 92 | 14.6 | 15.6 |
| Example 30 | 1.09 | 91 | 14.6 | 15.1 |
| Example 31 | 1.09 | 91 | 14.7 | 14.4 |

TABLE 1-continued

| | | | | |
|---|---|---|---|---|
| Comp. Ex. 1 | 1.14 | 85 | 13.8 | 13.8 |
| Comp. Ex. 2 | unmeasurable | 86 | 13.6 | 12.5 |
| Comp. Ex. 3 | 1.19 | 82 | 13.8 | 14.0 |
| Comp. Ex. 4 | 1.16 | 80 | 13.8 | 12.5 |

*1: Unmeasurable due to generation of chill crystals instead of columnar crystals.

TABLE 2

| | Content based on mass of elements in R-T-B based alloy strip | | | | | | | | | | |
|---|---|---|---|---|---|---|---|---|---|---|---|
| | Nd | Pr | Dy | Tb | Co | Cu | Al | Ga | Zr | B | Fe |
| Examples 1-6, Examples 16-18, Comp. Exs. 1-3 | 31.00 | 0.00 | 0.00 | 0.00 | 1.00 | 0.10 | 0.20 | 0.00 | 0.20 | 0.98 | 66.52 |
| Example 7 | 32.50 | 0.00 | 0.00 | 0.00 | 1.00 | 0.10 | 0.20 | 0.00 | 0.20 | 0.98 | 65.02 |
| Example 8 | 34.00 | 0.00 | 0.00 | 0.00 | 1.00 | 0.10 | 0.20 | 0.00 | 0.20 | 0.98 | 63.52 |
| Example 9 | 34.70 | 0.00 | 0.00 | 0.00 | 1.00 | 0.10 | 0.20 | 0.00 | 0.20 | 0.98 | 62.82 |
| Example 10 | 25.00 | 6.00 | 0.00 | 0.00 | 0.50 | 0.10 | 0.20 | 0.10 | 0.20 | 1.00 | 66.90 |
| Example 11 | 31.10 | 0.00 | 0.10 | 0.00 | 1.00 | 0.10 | 0.20 | 0.10 | 0.10 | 1.02 | 66.28 |
| Example 12 | 28.10 | 3.10 | 0.00 | 0.00 | 1.10 | 0.10 | 0.20 | 0.10 | 0.10 | 0.98 | 66.22 |
| Example 13 | 22.40 | 8.90 | 0.00 | 0.00 | 1.00 | 0.10 | 0.20 | 0.00 | 0.10 | 0.99 | 66.31 |
| Example 14 | 24.10 | 6.30 | 0.00 | 0.00 | 0.50 | 0.10 | 0.30 | 0.00 | 0.20 | 0.98 | 67.52 |
| Example 15 | 28.30 | 5.80 | 0.00 | 0.00 | 0.50 | 0.20 | 0.10 | 0.30 | 0.20 | 1.03 | 63.57 |
| Example 19 | 31.10 | 0.00 | 0.10 | 0.00 | 1.00 | 0.10 | 0.20 | 0.10 | 0.10 | 1.02 | 66.28 |
| Example 20 | 30.00 | 0.00 | 1.00 | 0.00 | 1.00 | 0.10 | 0.20 | 0.00 | 0.20 | 1.00 | 66.50 |
| Example 21 | 30.90 | 0.00 | 0.30 | 0.00 | 1.00 | 0.10 | 0.20 | 0.10 | 0.10 | 1.02 | 66.28 |
| Example 22 | 22.40 | 8.40 | 0.50 | 0.00 | 1.00 | 0.10 | 0.20 | 0.00 | 0.10 | 0.99 | 66.31 |
| Example 23 | 24.00 | 6.30 | 0.00 | 0.10 | 0.50 | 0.10 | 0.30 | 0.00 | 0.20 | 0.98 | 67.52 |
| Example 24 | 28.70 | 0.00 | 0.80 | 0.00 | 0.50 | 0.08 | 0.20 | 0.00 | 0.20 | 0.88 | 68.64 |
| Example 25 | 29.10 | 0.00 | 0.40 | 0.00 | 0.50 | 0.03 | 0.20 | 0.00 | 0.20 | 0.90 | 68.67 |
| Example 26 | 28.80 | 0.00 | 0.70 | 0.00 | 0.50 | 0.08 | 0.20 | 0.00 | 0.25 | 0.90 | 68.57 |
| Example 27 | 34.00 | 0.00 | 0.00 | 0.00 | 1.00 | 0.10 | 0.20 | 0.00 | 0.20 | 1.03 | 63.47 |
| Example 28 | 29.50 | 0.00 | 0.00 | 0.00 | 0.50 | 0.10 | 0.20 | 0.00 | 0.06 | 0.90 | 68.74 |
| Example 29 | 29.50 | 0.00 | 0.00 | 0.00 | 0.50 | 0.20 | 0.20 | 0.00 | 0.20 | 0.91 | 68.49 |
| Example 30 | 28.30 | 0.00 | 0.00 | 0.00 | 1.00 | 0.10 | 0.20 | 0.00 | 0.20 | 1.10 | 69.10 |
| Example 31 | 28.30 | 0.00 | 0.00 | 0.00 | 2.80 | 0.10 | 0.20 | 0.00 | 0.20 | 1.00 | 67.40 |
| Comp. Ex. 4 | 25.00 | 6.00 | 0.00 | 0.00 | 0.50 | 0.10 | 0.20 | 0.10 | 0.20 | 1.00 | 66.90 |

Units of values in the table are mass %. Values for Fe include unavoidable impurities.

The results shown in Table 1 confirmed that the R-T-B based sintered magnets of Examples 1 to 31 have excellent coercive force.

[Structural Analysis of R-T-B Based Sintered Magnets]

(Area and Standard Deviation for Triple Point Regions)

Figure 12:
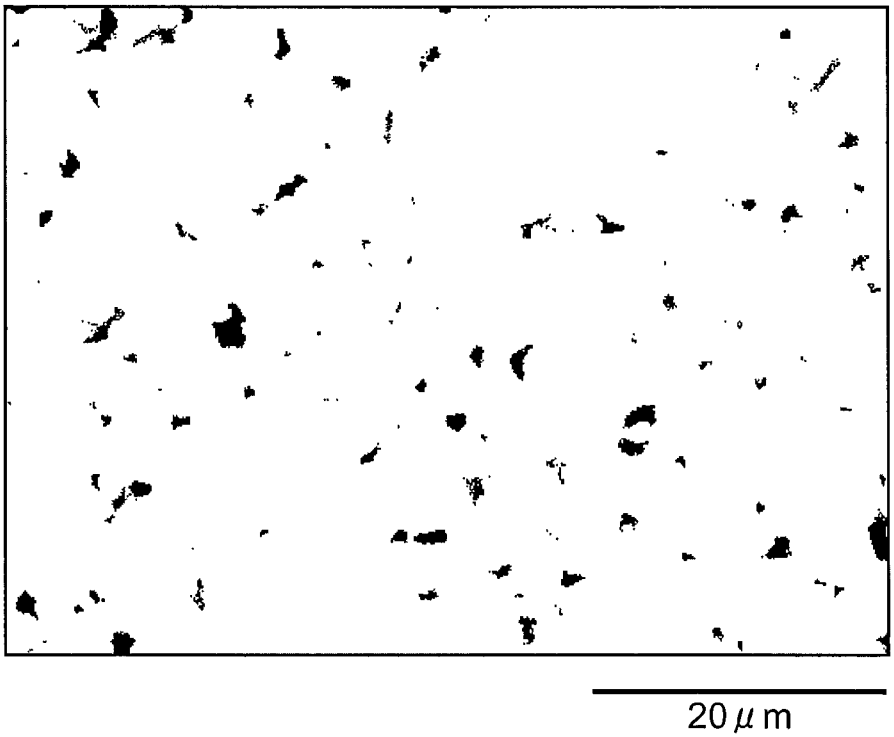
FIG. 12 is a diagram showing element map data for the rare earth sintered magnet of Example 10, with the triple point regions indicated in black.

For the R-T-B based sintered magnet of Example 10 there was used an electron beam microanalyzer (EPMA: JXA8500F Model FE-EPMA), and element map data were collected. The measuring conditions were: an acceleration voltage of 15 kV, an irradiation current of 0.1 μA and a count-time: of 30 msec, the data acquisition region was X=Y=51.2 μm, and the number of data points was X=Y=256 (0.2 μm-step). In the element map data, first triple point regions surrounded by 3 or more crystal grains are colored black, and by image analysis thereof, the average value for the area of the triple point regions and the standard deviation for the area distribution were calculated. FIG. 12 is a diagram showing element map data for the rare earth sintered magnet of Example 10, with the triple point regions indicated in black.

Figure 13:
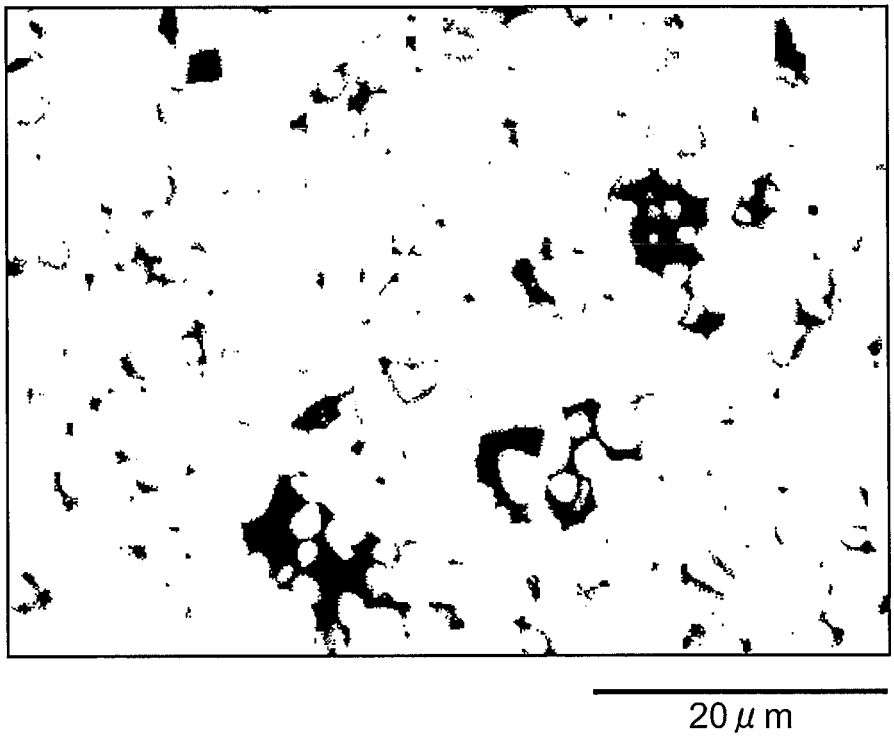
FIG. 13 is a diagram showing element map data for the R-T-B based sintered magnet of Comparative Example 4, with the triple point regions indicated in black.

The EPMA was used for structural observation of the R-T-B based sintered magnets of Examples 10 to 15 and Comparative Example 4 in the same manner as the R-T-B based sintered magnet of Example 10. FIG. 13 is a diagram showing element map data for the R-T-B based sintered magnet of Comparative Example 4, with the triple point regions indicated in black.

Image analysis was performed for Examples 10 to 15 and Comparative Example 4 in the same manner as Example 10, and the average value for the area of the triple point regions and the standard deviation for the area distribution were calculated. The results are shown in Table 3. As shown in Table 3, the R-T-B based sintered magnets of Examples 10 to 15 had sufficiently smaller values for the average value and standard deviation for the area of the triple point regions, compared to Comparative Example 4. These results confirmed that in Examples 10 to 15, segregation of the phase with a higher R content than the $R_2T_{14}B$ phase was inhibited.

(Mean Particle Diameter)

In addition, using a similar electron microscope observation image, the shapes of the $R_2T_{14}B$ phase crystal grains were discerned by image analysis, the diameters of each of the individual crystal grains were determined, and the arithmetic mean value was obtained. This was recorded as the mean particle diameter of the $R_2T_{14}B$ phase crystal grains. The results are shown in Table 3.

(Rare Earth Element Content of Triple Point Regions)

EPMA was used to determine the rare earth element content of the triple point regions of the R-T-B based sintered magnets of Examples 10 to 15 and Comparative Example 4, based on mass. The measurement was conducted for 10 triple point regions, and the range and standard deviation for the rare earth element content was determined. The results are shown in Table 3.

(Oxygen, Nitrogen and Carbon Contents)

A common gas analysis apparatus was used for gas analysis of the R-T-B based sintered magnets of Examples 10 to 15 and Comparative Example 4, and the oxygen, nitrogen and carbon contents were determined. The results are shown in Table 3.

TABLE 3

| | Mean particle diameter (μm) | Triple point region area Mean value ($\mu m^2$) | S.D. | Rare earth elements of triple point regions Content (mass %) | S.D. | Oxygen content (ppm) | Nitrogen content (ppm) | Carbon content (ppm) |
|---|---|---|---|---|---|---|---|---|
| Example 10 | 3.32 | 1.2 | 1.1 | 92-98 | 2.4 | 590 | 560 | 1100 |
| Example 11 | 3.25 | 1.8 | 2.6 | 91-98 | 2.7 | 890 | 820 | 950 |
| Example 12 | 3.43 | 1.5 | 2.3 | 92-98 | 2.5 | 780 | 780 | 1020 |
| Example 13 | 3.22 | 1.7 | 2.1 | 91-98 | 2.8 | 650 | 870 | 980 |
| Example 14 | 4.31 | 1.3 | 1.5 | 92-98 | 2.1 | 530 | 680 | 1440 |
| Example 15 | 3.86 | 1.9 | 1.7 | 93-98 | 2.6 | 1420 | 1010 | 1380 |
| Comp. Ex. 4 | 3.65 | 3.4 | 7.1 | 82-98 | 5.7 | 800 | 760 | 1380 |

A shown in Tables 1 and 3, although Example 10 and Comparative Example 4 both used alloy powder having about the same mean particle diameter, the R-T-B sintered magnet obtained in Example 10 had a higher HcJ value. This is presumably because the R-T-B based sintered magnet of Example 10 not only had a finer crystal grain particle diameter, but also had more uniform particle diameters and shapes of the crystal grains, and therefore reduced segregation of the triple point regions.

INDUSTRIAL APPLICABILITY

According to the invention it is possible to provide an alloy strip that can increase the coercive force of an R-T-B based sintered magnet. It is also possible to provide an R-T-B based sintered magnet having sufficiently excellent coercive force, as well as a method for producing it.

EXPLANATION OF SYMBOLS

1: Crystal nuclei, 2: columnar crystal, 4: grain boundary phase (heterophase), 10: high-frequency melting furnace, 12: molten alloy, 14: tundish, 16: cooling roll, 17: roll surface, 18: alloy strip, 19: gas tube, 19*a*: gas blow hole, 20: secondary cooling section, 32, 34: recesses, 36: raised section, 100: R-T-B based sintered magnet, 120: crystal grain, 140: triple point region (grain boundary region), 40: rotor, 42: core, 50: stator, 52: coil, 200: motor.

The invention claimed is:

1. An R-T-B based alloy strip comprising columnar crystals of an $R_2T_{14}B$ phase, wherein R represents at least one element selected from the group consisting of rare earth elements, T represents at least one of iron and cobalt, and B represents boron, wherein in a cross-section along the thickness direction, columnar crystals extend out in a radial fashion from the crystal nuclei, the R-T-B based alloy strip satisfying the following inequality (1), where $D_1$ and $D_2$ are, respectively, the average value for the lengths of the columnar crystals on one side and the average value for the lengths on the other side that is opposite the one side, in the direction perpendicular to the thickness direction of the cross-section, $$1 \leq D_2/D_1 \leq 1.1 \quad (1).$$

2. The R-T-B based alloy strip according to claim 1, satisfying the following inequalities (2) and (3), where $D_{AVE}$ and $D_{MAX}$ are, respectively, the average value and the maximum value for the lengths of the columnar crystals in the direction perpendicular to the thickness direction in the cross-section $$1.0\ \mu m \leq D_{AVE} \leq 3.0\ \mu m \quad (2)$$

$$1.5\ \mu m \leq D_{MAX} \leq 4.5\ \mu m \quad (3).$$

3. The R-T-B based alloy strip according to claim 1, containing an R-rich phase in which the R content is higher than the $R_2T_{14}B$ phase based on mass, the percentage of the number of R-rich phases with lengths of no greater than 1.5 μm in the direction perpendicular to the thickness direction, with respect to the total number of R-rich phases, in the cross-section, being 90% or greater.

4. An R-T-B based sintered magnet obtained by molding and firing alloy powder obtained by grinding the R-T-B based alloy strip according to claim 1.

5. A method for producing an R-T-B based sintered magnet, the method comprising the steps of:

grinding the R-T-B based alloy strip according to claim 1 to prepare an alloy powder, and molding and firing the alloy powder to produce the R-T-B based sintered magnet.

6. A method for producing an R-T-B based sintered magnet, the method comprising the steps of:

grinding the R-T-B based alloy strip according to claim 2 to prepare an alloy powder, and molding and firing the alloy powder to produce the R-T-B based sintered magnet.

* * * * *